US006457540B2

(12) United States Patent
Gardes

(10) Patent No.: US 6,457,540 B2
(45) Date of Patent: Oct. 1, 2002

(54) METHOD AND SYSTEM FOR HYDRAULIC FRICTION CONTROLLED DRILLING AND COMPLETING GEOPRESSURED WELLS UTILIZING CONCENTRIC DRILL STRINGS

(76) Inventor: Robert Gardes, P.O. Box 92593, Lafayette, LA (US) 70509

( * ) Notice: Subject to any disclaimer, the term of this patent is extended or adjusted under 35 U.S.C. 154(b) by 12 days.

(21) Appl. No.: 09/771,746

(22) Filed: Jan. 29, 2001

Related U.S. Application Data

(63) Continuation-in-part of application No. 09/575,874, filed on May 22, 2000, which is a continuation-in-part of application No. 09/026,270, filed on Feb. 19, 1998, now Pat. No. 6,065,550, which is a continuation-in-part of application No. 08/595,594, filed on Feb. 1, 1996, now Pat. No. 5,720,356.

(51) Int. Cl.[7] ..... E21B 7/04; E21B 43/12
(52) U.S. Cl. ..... 175/62; 175/70; 166/50
(58) Field of Search ..... 175/61, 62, 69, 175/70; 166/50, 313

(56) References Cited

U.S. PATENT DOCUMENTS

| | | | | |
|---|---|---|---|---|
| 4,852,666 | A | 8/1989 | Brunet et al. | 166/117.5 |
| 5,394,950 | A | 3/1995 | Gardes | 175/45 |
| 5,411,105 | A | 5/1995 | Gray | 175/69 |
| 5,435,400 | A | 7/1995 | Smith | 175/80 X |
| 5,720,356 | A | 2/1998 | Gardes | 175/62 |
| 6,065,550 | A | 5/2000 | Gardes | 175/62 |

OTHER PUBLICATIONS

Production '91 Coiled tubing . . . operations and services Part 1; World Oil, Nov. 1991.
Coiled tubing . . . operations and services Part 2; World Oil, Dec. 1991.
Coiled tubing . . . operations and services Part 3; World Oil; Jan. 1992.
Coiled tubing . . . operations and services Part 6; World Oil; May 1992.
Coiled tubing . . . operations and services Part 7; World Oil; Jun. 1992.
Coiled tubing . . . operations and services; Part 11; World Oil; Nov. 1992.
Coiled tubing . . . operations and services; Part 14; World Oil; Apr. 1993.
Coiled tubing . . . operations and services; Part 15; World Oil; May 1993.
Coiled tubing 1994: Enhanced Value through innovation; World Oil; Jan. 1994.

(List continued on next page.)

(57) ABSTRACT

A method and system of drilling straight directional and multilateral wells utilizing hydraulic frictional controlled drilling, by providing concentric casing strings to define a plurality of annuli therebetween; injecting fluid down some of the annuli; returning the fluid up at least one annulus so that the return flow creates adequate hydraulic friction within the return annulus to control the return flow within the well. The hydraulic friction should be minimized on the injection side to require less hydraulic horsepower and be maximized on the return side to create the desired subsurface friction to control the well.

6 Claims, 18 Drawing Sheets

OTHER PUBLICATIONS

Oryx horizontal well first using coiled tubing; Drilling Contractor; May 1992.
The Coiled Tubing Boom; Petroleum Engineer International; Apr. 1991.
Coiled Tubing; Shell Launches 68–Well Drilling Program Using Coiled Tubing; Petroleum Engineer International; Sep. 1994.
Coiled Tubing; Where Is The Coiled Tubing Wave Headed?; Petroleum Engineer International; Sep. 1994.
Drilling Innovation; Horizontal Drilling With Coiled Tubing Gains Momentum; Petroleum Engineer International; Jul. 1992.
Drilling Technology; Evolution of Coiled Tubing Drilling Technology Accelerates; Petroleum Engineer International; Sep. 1993.
Drilling Technology Report OGJ SPECIAL; Coiled tubing used for slim hole re–entry; Oil & Gas Journal; Feb. 1992.
Designing slurries for coiled tubing cement squeezes; World Oil; Jun. 1992.
Coiled Tubing . . . A Developing Technology With Reel Potential; Petroleum Engineer International.
Special Report: Horizontal Drilling; CT's Future Tied to Horizontal Drilling; The American Oil & Gas Report; Jul. 1994.

*Primary Examiner*—William Neuder
(74) *Attorney, Agent, or Firm*—Garvey, Smith, Nehrbass & Doody, LLC; Gregory C. Smith

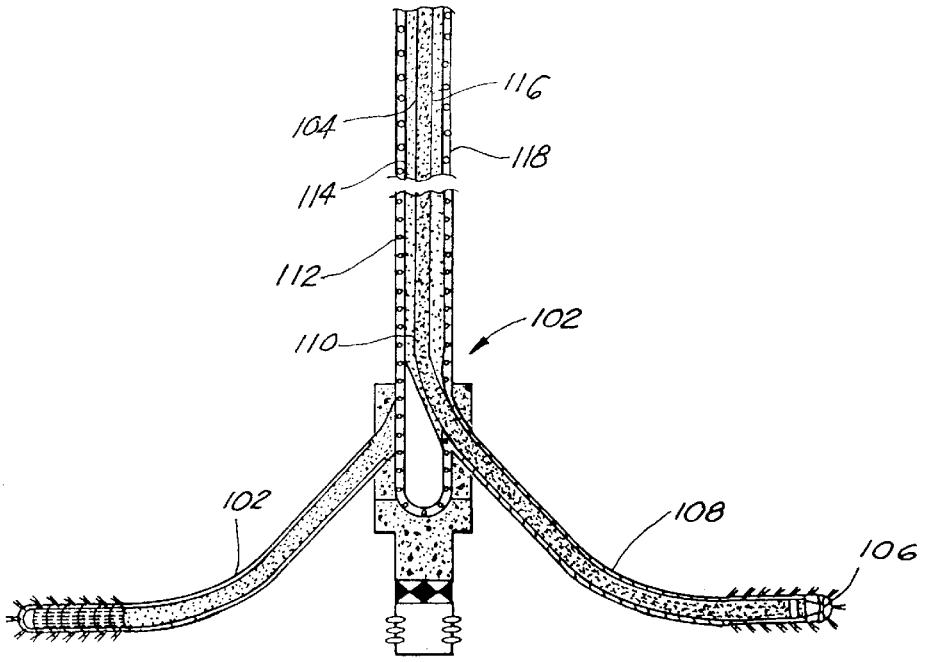
FIG. 10A
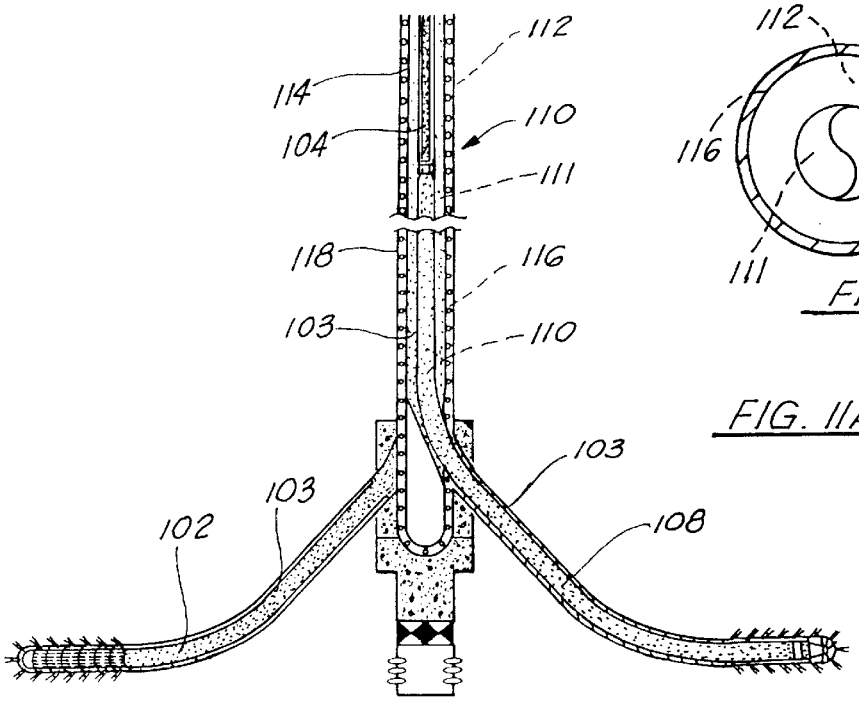
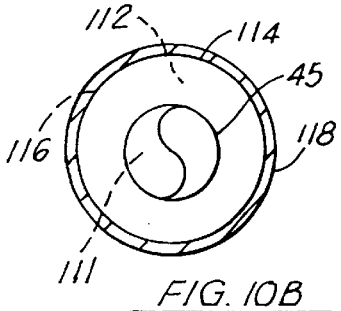
FIG. 10B
FIG. 11A

METHOD AND SYSTEM FOR HYDRAULIC FRICTION CONTROLLED DRILLING AND COMPLETING GEOPRESSURED WELLS UTILIZING CONCENTRIC DRILL STRINGS

CROSS-REFERENCE TO RELATED APPLICATIONS

This is a continuation-in-part application of U.S. patent application Ser. No. 09/575,874, filed May 22, 2000, which was a continuation-in-part application of U.S. patent application Ser. No. 09/026,270 filed Mar. 19, 1998, now U.S. Pat. No. 6,065,550, which is a continuation-in-part of Ser. No. 08/595,594, filed Feb. 1, 1996, now U.S. Pat. No. 5,720,356, all incorporated herein by reference.

STATEMENT REGARDING FEDERALLY SPONSORED RESEARCH OR DEVELOPMENT

Not applicable

REFERENCE TO A"MICROFICHE APPENDIX"

Not applicable

BACKGROUND OF THE INVENTION

1. Field of the Invention

The system of the present invention relates to drilling and completing of high pressure/high temperature oil wells. More particularly, the present invention relates to a system and method FOR HYDRAULIC FRICTION CONTROLLED DRILLING AND COMPLETING GEOPRESSURED WELLS UTILIZING CONCENTRIC DRILL STRING OR STRINGS. The annular hydrostatic and increased frictional effects of multi-phase flow from concentric drill string or strings manages pressure and does not allow reservoir inflow or high annular flowing pressures at surface.

2. General Background of the Invention

In the general background of the applications and patents which are the precursors to this application, a thorough discussion of drilling and completing wells in an underbalanced state while the well was kept alive was undertaken, and will not be repeated, since it is incorporated by reference herein. The present inventor, Robert A. Gardes, the named patentee in U.S. Pat. Nos. 5,720,356 and 6,065,550 patented a method and system which covers among other things, the sub-surface frictional control of a drilling well by means of a combination of both annulus and standpipe or CTD fluid injection. His original patent covered methods and systems for drilling and completing underbalanced multi-lateral wells using a dual string technique in a live well. Through a subsequent improvement patent, he has also addressed well control through dual string fluid injection. Therefore, what is currently being accomplished in the art is the attempts to undertake underbalanced drilling and to trip out of the hole without creating formation damage thereby controlling the pressure, yet hold the pressure so that one can trip out of the well with the well not being killed and maintaining a live well.

The present inventor has determined that by pumping an additional volume of drilling fluid through a concentric casing string or strings, the bottom hole equivalent circulating pressure (ECD) can be maintained by replacing hydrostatic pressure with frictional pressure thus the wellbore will see a more steady state condition. The pump stops and starts associated with connections in the use of jointed pipe can be regulated into a more seamless circulating environment. By simply increasing the annular fluid rate during connections by a volume approximately equal to the normal standpipe rate, the downhole environment in the wellbore sees a near constant ECD, without the usual associated pressure spikes. For geopressured wells, the loss in hydrostatic pressure at total depth due to the loss of frictional circulating effects whenever the pumps are shut down (as in a connection) can cause reservoir fluids, especially high-pressured gas, to influx into the wellbore causing a reduction in hydrostatic pressure. In deep, high fluid density wells this "connection gas" can become an operational problem and concern. This is especially true in certain critical wells that have a narrow operating envelope between equivalent circulating density (ECD) and fracture gradient.

Therefore, what has been developed by the present inventor is an innovative and new drilling technique to provide an additional level of well control beyond that provided with conventional hydrostatically controlled drilling technology. This process involves the implementation of one or more annular fluid injection options to compliment the standpipe injection through the jointed pipe drill string or through a coil pipe injection in a coiled tubing drilling (CTD) process. The method has been designed in conjunction with flow modeling to provide a higher standard of well control, and has been successfully field tested and proven.

BRIEF SUMMARY OF THE INVENTION

The system and method of the present invention provides is a system for drilling geopressured wells utilizing hydraulic friction on the return annulus path downhole to impose a variable back pressure upon the formation at any desired level from low head, to balanced and even to underbalanced drilling. Control of the back pressure is dependent upon a secondary annulus fluid injection that results in additional frictional well control. Higher concentric casing annular injection rate leads to higher friction pressure, and lower fluid rates cause lower friction pressures and back pressures. For connections additional flow is injected into the annulus to offset the normal standpipe injection rate and maintain near constant bottom hole circulating rates and ECD on the formation.

Stated otherwise the invention provides a method of pressure controlling the drilling of wells, by providing a principal drill string; providing a plurality of concentric casing string or strings surrounding at least a portion of the principal drill string; and pumping a controlled volume of fluid down the plurality of concentric casing string or strings and returning the fluid up a common return annulus for both the principal drill string and microannulus strings, so that the friction caused by the fluid flow up the common return annulus is greater than the friction caused by the fluid flow of just the concentric casings or drill string to frictionally control the well.

Therefore, it is a principal object of the present invention to provide a drilling technique to give operators drilling critical high-pressure wells an additional level of well control over conventional hydrostatic methods utilizing hydraulic friction on the return annulus path downhole;

It is a further principal object of the present invention to provide multi phase annular friction created by hydraulic friction to control the well for kill operations, by having a secondary location for fluid injection in combination with the drill pipe or coiled tubing;

It is a further principal object of the present invention to utilize hydraulic friction on the return annulus path downhole to impose a variable back pressure upon the formation at any desired level from low head, to balanced and even to underbalanced drilling;

It is a further principal object of the present invention to provide a system of controlling well flow by matching injection and return annuli to achieve the desired high fluid injection rates at relatively low surface pressures and hydraulic horsepower, and the high return side frictional pressure losses that are needed for adequate flow control.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein:

FIG. 10A illustrates an isolated view of the lower portion of the drilling/completion subsystem as fully illustrated in FIG. 10;

FIG. 10B illustrates a cross-sectional view of the outer casing housing the carrier string, and the drill pipe within the carrier string in the dual string drilling system utilizing segmented drill pipe;

FIG. 11A illustrates an isolated view of the lower portion of the drilling/completion subsystem as fully illustrated in FIG. 11;

DETAILED DESCRIPTION OF THE INVENTION

Figure 1:
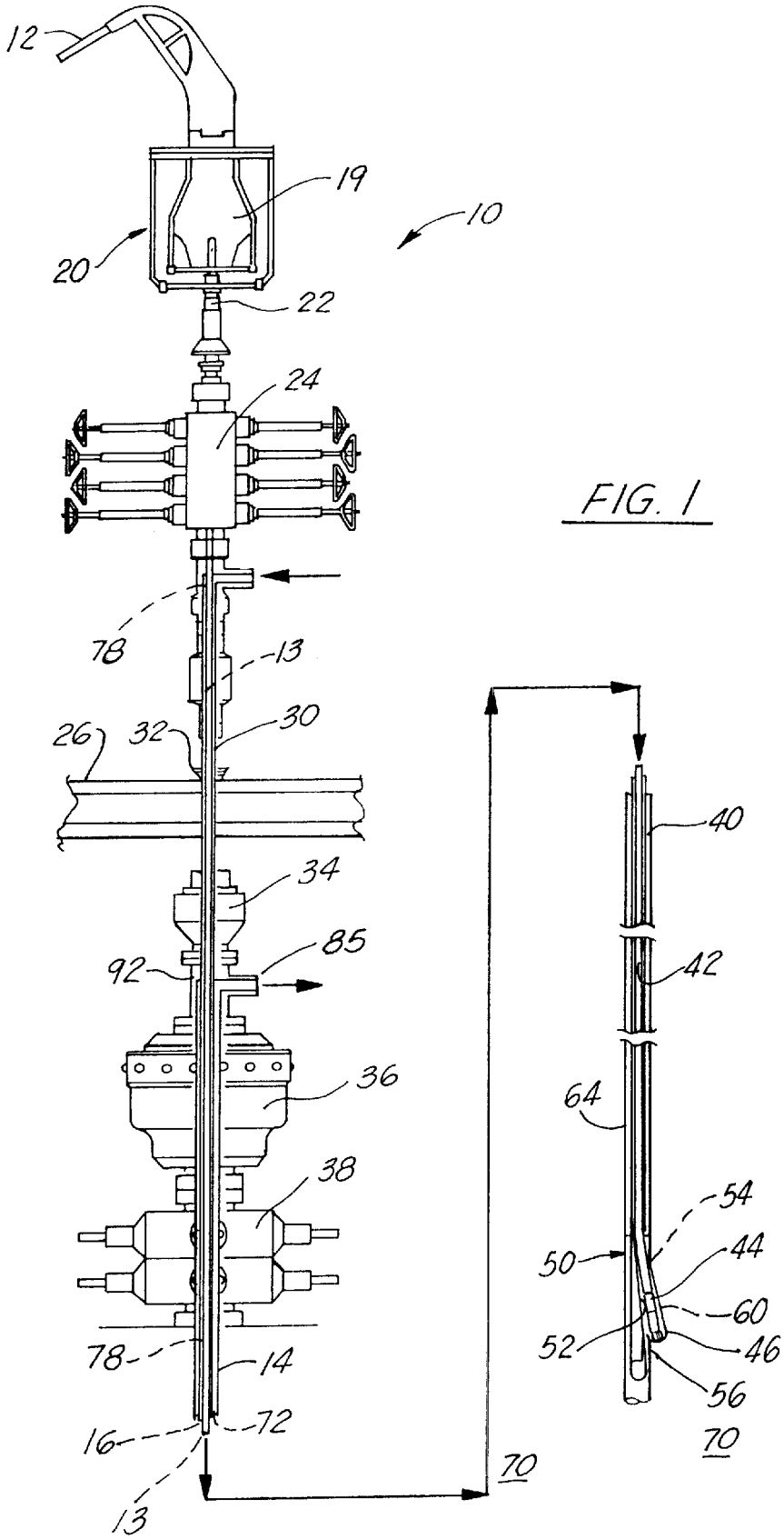
FIG. 1 illustrates an overall view of the two string underbalanced drilling technique utilizing coiled tubing as the drill string in the drilling of multiple radials.
Figures 2, 2A:
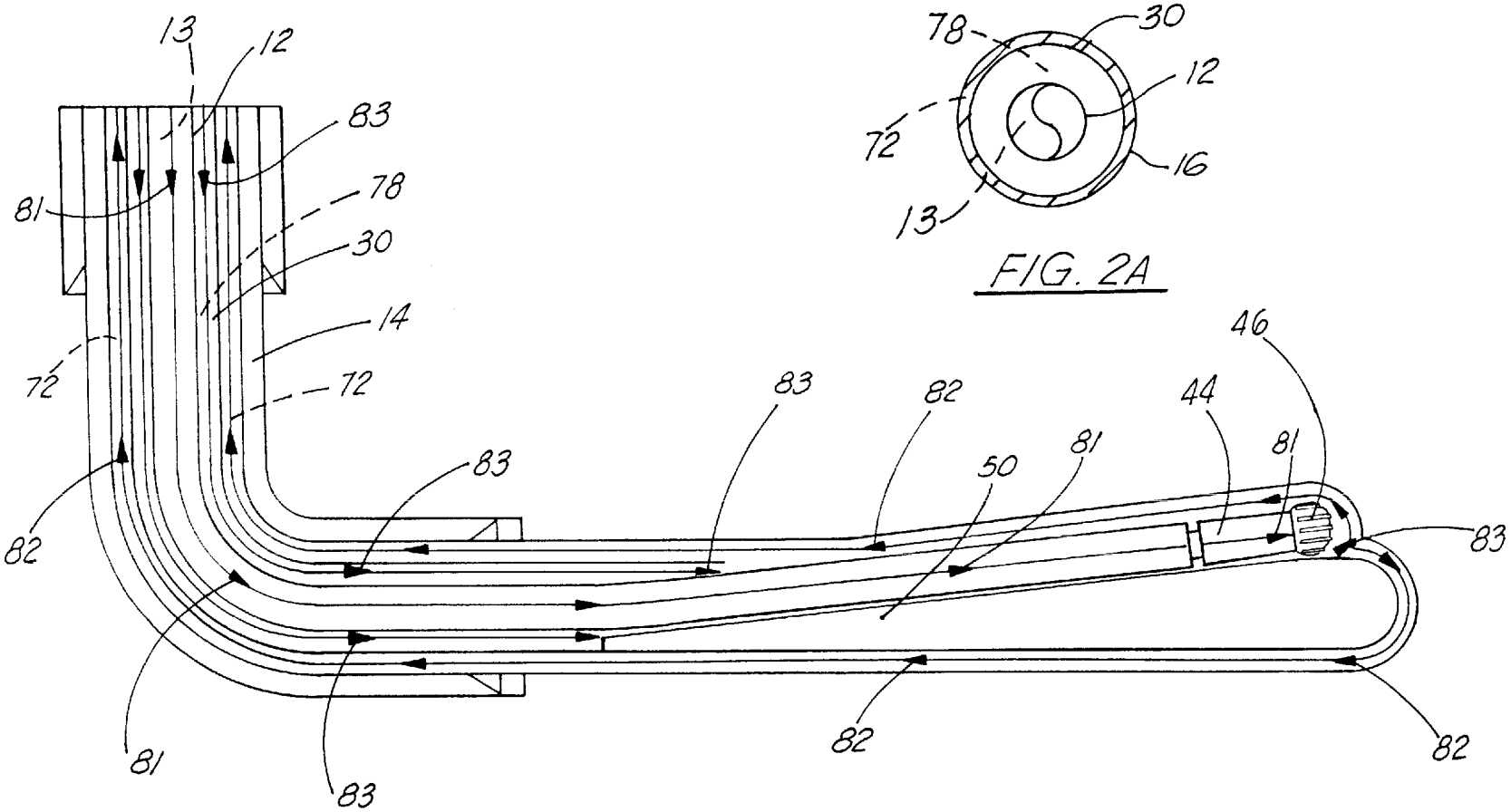
FIGS. 2 and 2A illustrates partial cross-sectional views of the whipstock or upstock portion of the two string drilling technique and the fluids flowing therethrough during the underbalanced drilling process utilizing coiled tubing.

FIGS. 1–2 illustrate the embodiments of the system and method for drilling underbalanced radial wells utilizing a dual string technique in a live well as disclosed and claimed in the patents and patent applications which relate to the present invention. The specification relating to FIGS. 1–12 will be recited herein. However, for reference to the improvements as will be claimed for this embodiment, in addition to FIGS. 1 through 12, reference is made to FIGS. 13 and 14 which will follow the discussion of FIGS. 1 through 12.

As illustrated in FIG. 1, what is provided is a drilling system 10 utilizing coil tubing as the drill string. As illustrated, the coil tubing 12 which is known in the art, and comprises a continuous length of tubing, which is lowered usually into a cased well having an outer casing 14 placed to a certain depth within the borehole 16. It should be kept in mind that during the course of this application, reference will be made to a cased borehole 16, although the system and method of the present invention may be utilized in a non-cased or "open" borehole, as the case may be. Returning to FIG. 1, the length of coil tubing 12 is inserted into the injector head 19 of the coil tubing assembly 20, with the coil tubing 12 being rolled off of a continuous reel mounted adjacent the rig floor 26. The coil tubing 12 is lowered through the stripper 22 and through the coil tubing blowout preventer stack 24 where it extends down through the rig floor 26 where a carrier string 30 is held in place by the slips 32. Beneath the rig floor 26 there are a number of systems including the rotating drill head 34, the hydril 36, and the lower BOP stack 38, through which the coil tubing 12 extends as it is moved down the carrier string 30. It should be understood that when coiled tubing 12 is utilized in the drilling of oil wells, the drill bit is rotated by the use of a drill motor, since the coiled tubing is not rotated as would be segmented drill pipe.

Since the system in which the coil tubing 12 is being utilized in this particular application is a system for drilling radial wells, on the lower end of the coil tubing 12, there are certain systems which enable it to be oriented in a certain direction downhole so that the proper radial bore may be drilled from the horizontal or vertical lined cased borehole 16. These systems may include a gyro, steering tool, electromagnetic MWD and fluid pulsed MWD, at the end of which includes a mud motor 44, which rotates the drill bit 46 for drilling the radial well. As further illustrated in FIG. 1, on the lower end of the carrier string 30 there is provided a deflector means which comprises an upstock 50, which is known in the art and includes an angulated ramp 52, and an opening 54 in the wall 56 of the upstock 50, so that as the drill bit 46 makes contact with the ramp 52, the drill bit 46 is deflected from the ramp 52 and drills through the wall 56 of the casing 14 for drilling the radial borehole 60 from the cased borehole 16. In a preferred embodiment, there may be a portion of composite casing 64 which has been placed at a predetermined depth within the borehole, so that when the drill bit 46 drills through the wall 56 of the casing 14 at that predetermined depth, the bit easily cuts through the composite casing and on to drill the radial well.

Following the steps that may be taken to secure the radial bore as it enters into the cased well 14, such as cementing or the like, it is that point that the underbalanced drilling technique is undertaken. This is to prevent any blowout or the like from moving up the borehole 16 onto the rig 26 which would damage the system on the rig or worse yet, injure or kill workers on the rig. As was noted earlier in this application, the underbalanced technique is utilized so that the fluids that are normally pumped down the borehole 16, in order to maintain the necessary hydrostatic pressure, are not utilized. What is utilized in this type of underbalanced drilling, is a combination of fluids which are of sufficient weight to maintain a lower than formation hydrostatic pressure in the borehole yet not to move into the formation 70 which can cause formation damage.

In order to carry out the method of the system, reference is made to FIGS. 1 and 2. Again, one should keep in mind that the outer casing 14 lines the formation 70, and within the outer casing 14 there is a smaller carrier string 30 casing, which may be a 5" casing, which is lowered into the outer casing 16 thus defining a first annulus 72, between the inner wall of the outer casing 16 and the outer wall of the carrier string 30. The carrier string 30 would extend upward above the rig floor 26 and would receive fluid from a first pump means 76 (see FIG. 7A), located on the rig floor 26 so that fluid is pumped within the second annulus 78. Positioned within the carrier string 30 is the coil tubing 12, which is normally 2" in diameter, and fits easily within the interior annulus of the carrier string, since the drill bit 46 on the coil tubing 12 is only 4¾" in diameter. Thus, there is defined a second annulus 78 between the wall of the coil tubing 12 and the wall of the carrier string 30. Likewise, the coil tubing 12 has a continuous bore therethrough, so that fluid may be pumped via a second pump 79 (see FIG. 7A) through the coil tubing annulus 13 in order to drive the 3⅜" mud motor and drive the 4¾" bit 46.

Therefore, it is seen that there are three different areas through which fluid may flow in the underbalanced technique of drilling. These areas include the inner bore 13 of the coil tubing 12, the first annulus 72 between the outer wall of the carrier string 30 and the inner wall of the outer casing 16, and the second annulus 78 between the coil tubing 12 and the carrier string 30. Therefore, in the underbalanced technique as was stated earlier, fluid is pumped down the bore 13 of the coil tubing 12, which, in turn, activates the mud motor 44 and the drill bit 46. After the radial well has been begun, and the prospect of hydrocarbons under pressure entering the annulus of the casings, fluids must be pumped downhole in order to maintain the proper hydrostatic pressure. However, again this hydrostatic pressure must not be so great as to force the fluids into the formation. Therefore, in the preferred embodiment, in the underbalanced multilateral drilling technique, nitrogen gas, air, and water may be the fluid pumped down the borehole 13 of the coil tubing 12, through a first pump 79, located on the rig floor 36. Again, this is the fluid which drives the motor 44 and the drill bit 46. A second fluid mixture of nitrogen gas, air and fluid is pumped down the second annulus 78 between the 2" coiled tubing string 12 and the carrier string 30. This fluid flows through second annulus 78 and again, the fluid mixture in annulus 78 in combination with the fluid mixture through the bore 13 of the coil tubing 12 comprise the principal fluids for maintaining the hydrostatic pressure in the underbalanced drilling technique. So that the first fluid mixture which is being pumped through the bore 13 of the coil tubing 12, and the second fluid mixture which is being pumped through the second annular space 78 between the carrier string 30 and the coil tubing 12, reference is made to FIG. 2 in order understand the manner in which the fluid is returned up to the rig floor 26 so that it does not make invasive contact with the formation.

Figure 6:
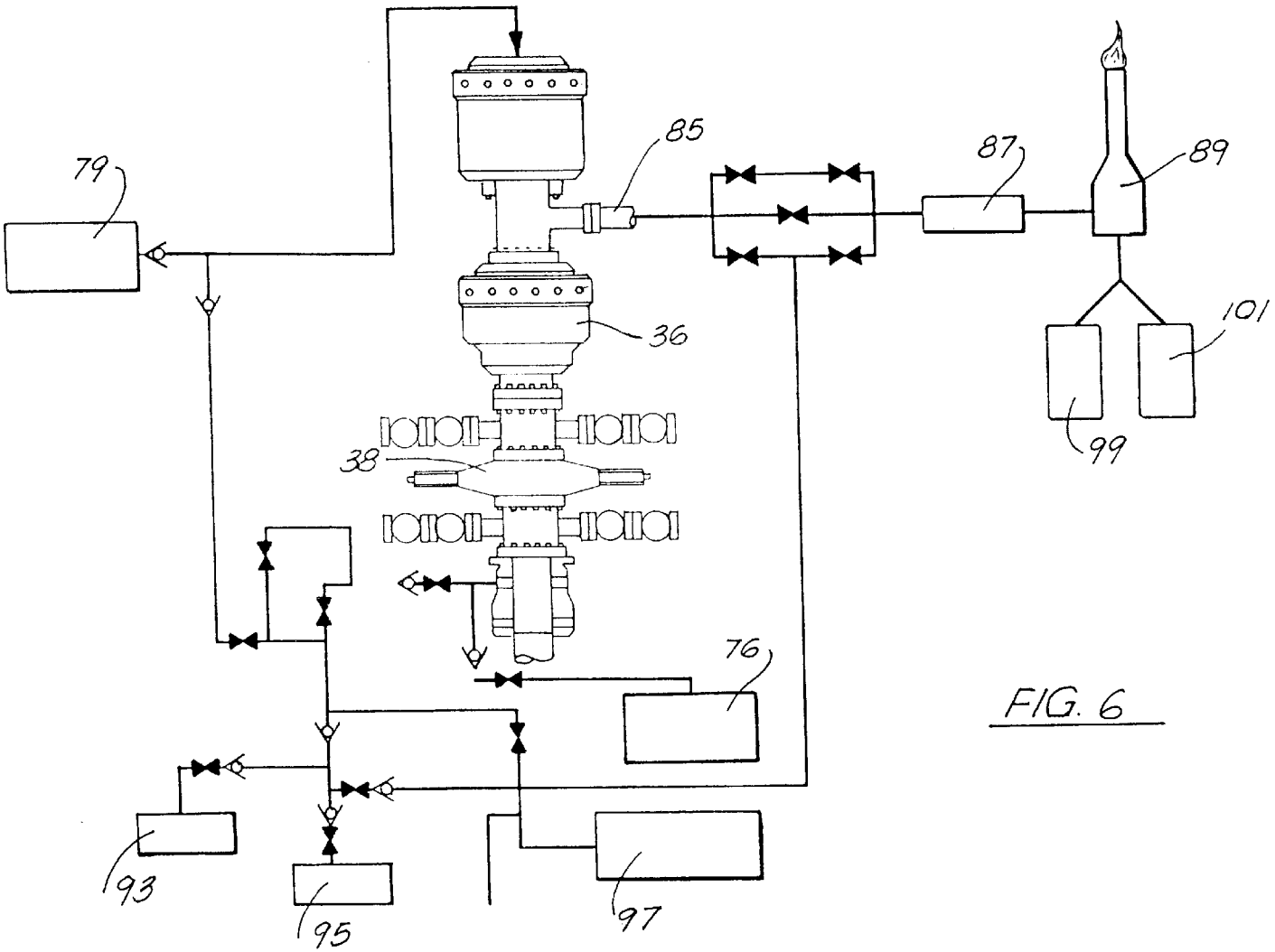
FIG. 6 illustrates an overall schematic view of an underbalanced drilling system utilized in the system of the method of the present invention.

As seen in FIG. 2, the fluid mixture through the bore 13 of the coil tubing 12 flows through the bore 13 and drives the mud motor 44 and flows through the drill bit 46. Simultaneously the fluid mix is flowing through the second annular space 78 between the carrier string 30 and the coil tubing 12, and likewise flows out of the upstock 50. However, reference is made to the first annular space between the outer casing 14 and the carrier string 30, which is that space 72 which returns any fluid that is flowing downhole back up to the rig floor 26. As seen in FIG. 2, arrows 81 represent the fluid flow down the bore 13 of the coil tubing 12, arrows 83 represent the second fluid flowing through the second annular space 78 into the borehole 12, and arrow 82 represents the return of the fluid in the first annular space 72. Therefore, all of the fluid flowing into the drill bit 46 and into the bore 12 so as to maintain the hydrostatic pressure is immediately returned up through the outer annular space 72 to be returned to the separator 87 through pipe 85 as seen in FIGS. 1 & 6.

FIG. 2A illustrates in cross sectional view the dual string system, wherein the coiled tubing 12 is positioned within the carrier string 30, and the carrier string is being housed within casing 16. In this system, there would be defined an inner bore 13 in coiled tubing 12, a second annulus 78 between the carrier string 30 and the coiled tubing 12, and a third annulus 72 between the casing 18 and the carrier string 30. During the process of recovery, the drilling or completion fluids are pumped down annuli 13 and 78, and the returns, which may be a mixture of hydrocarbons and drilling fluids are returned up through annulus 72.

Figure 3C:
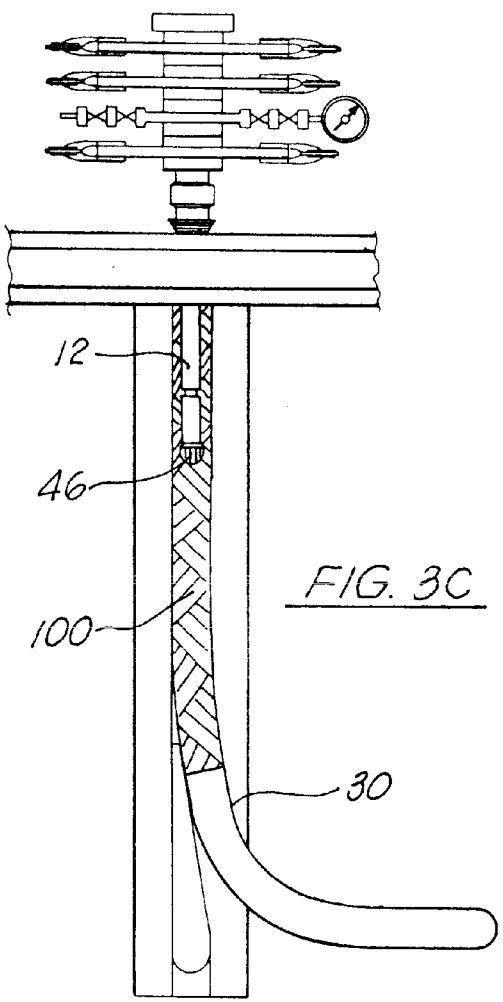
FIGS. 3A–3C illustrate views of the underbalanced drilling technique utilizing single phase concentric string circulation for maintaining the underbalanced status of the well during a retrieval of the coiled tubing drill string.
Figure 3B:
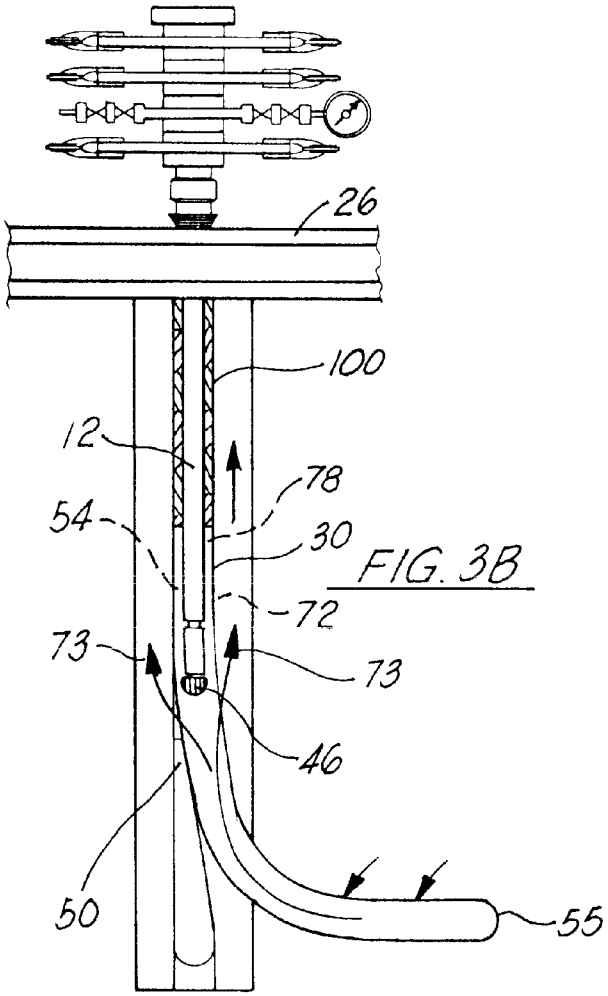
Figure 3A:
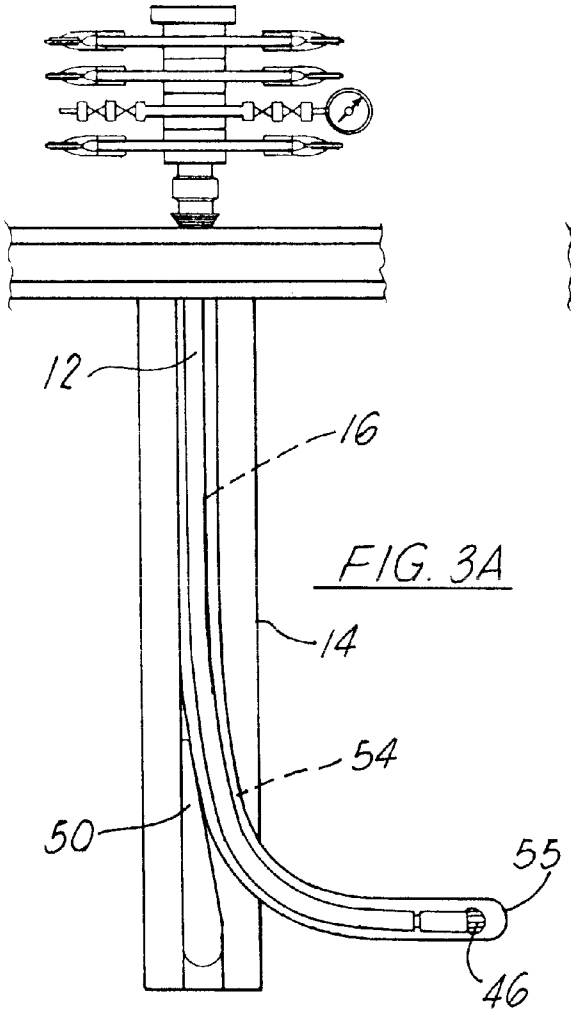

During the drilling technique should hydrocarbons be found at one point during this process, then the hydrocarbons will likewise flow up the annular space 72 together with the return air and nitrogen and drilling fluid that was flowing down through the tube flowbores or flow passageways 13 and 78. At that point, the fluids carrying the hydrocarbons if there are hydrocarbons, flow out to the separator 87, where in the separator 87, the oil is separated from the water, and any hydrocarbon gases then go to the flare stack 89 (FIG. 6). This schematic flow is seen in FIG. 6 of the application. One of the more critical aspects of this particular manner of drilling wells in the underbalanced technique, is the fact that the underbalanced drilling technique would be utilized in the present invention in the way of drilling multiple radial wells from one vertical or horizontal well without having to kill the well in order to drill additional radials. This was discussed earlier. However, as illustrated in FIGS. 3A–3C, reference is made to the sequential drawings, which illustrate the use of the present invention in drilling radial wells. For example, as was discussed earlier, as seen in FIG. 3A, when the coil tubing 12 encounters the upstock 50, and bores through an opening 54 in the wall of outer casing 14, the first radial is then drilled to a certain point 55. At some point in the drilling, the coil tubing string 12 must be retrieved from the borehole 16 in order to make BHA changes or for completion. In the present state of the art, what is normally accomplished is that the well is killed in that sufficient hydrostatically weighted fluid is pumped into the wellbore to stop the formation from producing so that there can be no movement upward through the borehole by hydrocarbons under pressure while the drill string is being retrieved from the hole and subsequently completed.

This is an undesirable situation. Therefore, what is provided as seen in FIGS. 3B and 3C, where the coil tubing 12, when it begins to be retrieved from the hole, there is provided a trip fluid 100, circulated into the second annular space 78 between the wall of the coil tubing 12 and the wall of the carrier string 30. This trip fluid 100 is a combination of fluids, which are sufficient in weight hydrostatically and frictionally as to control the amount of drilling fluids and hydrocarbons from flowing through the carrier string 30 upward, yet do not go into the formation. Rather, if there are hydrocarbons which flow upward they encounter the trip fluid 100 and flow in the direction of arrows 73 through the first annular space 72 between the carrier string 30 and the outer casing 14, and flow upward to the rig floor 26 and into the separators 87 as was discussed earlier. However, the carrier string 30 is always "alive" as the coil tubing 12 with the drill bit 46 is retrieved upward. As seen in FIG. 3C, the trip fluid 100 is circulated within the carrier string 30, so that as the drill bit 46 is retrieved from the bore of the carrier string 30, the trip fluid 100 maintains a certain equilibrium within the system, and the well is maintained alive and under control.

Figure 4A:
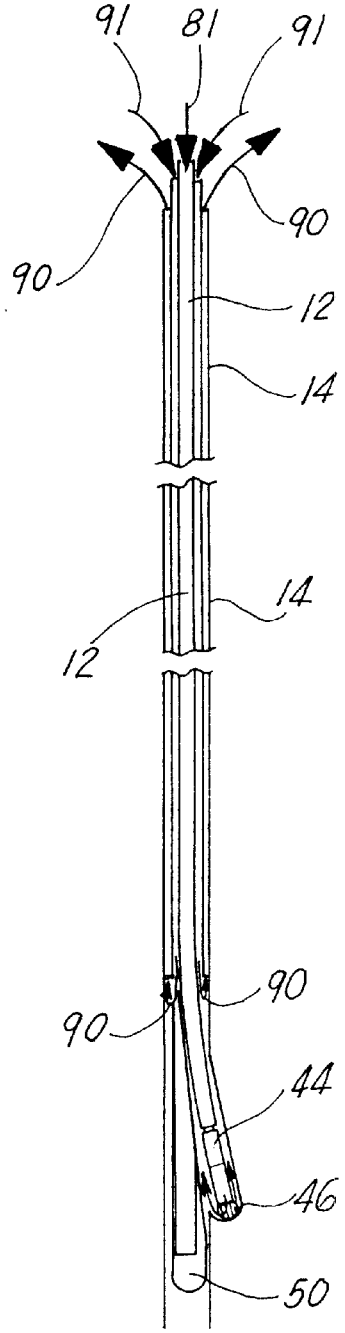
FIGS. 4A & 4B illustrate a flow diagram for underbalanced drilling utilizing a two-string drilling technique in an upstock assembly with the fluid being returned through the annulus between the carrier string and the outer string.
Figure 4B:
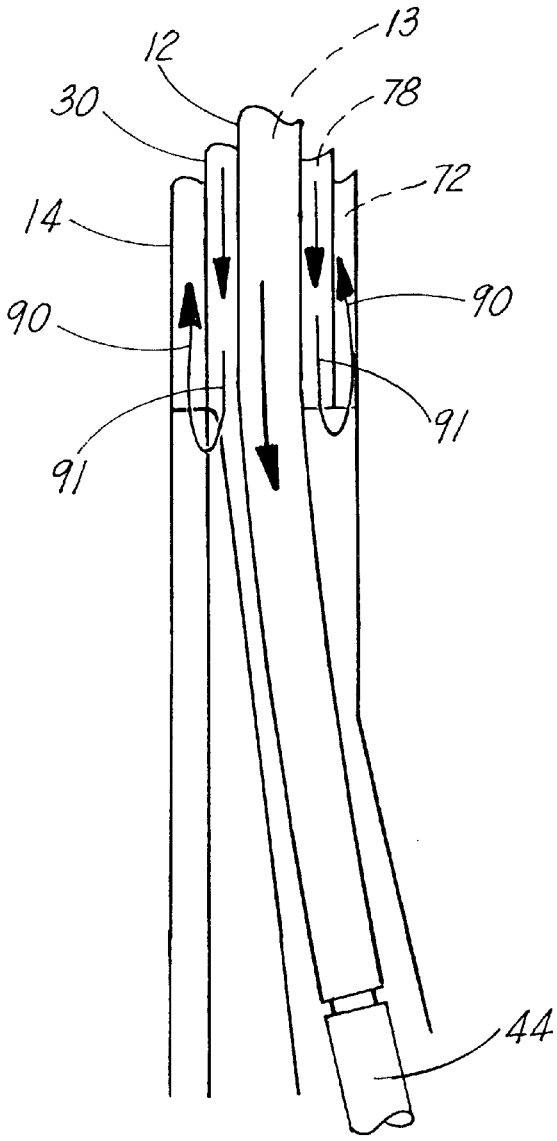
Figure 5:
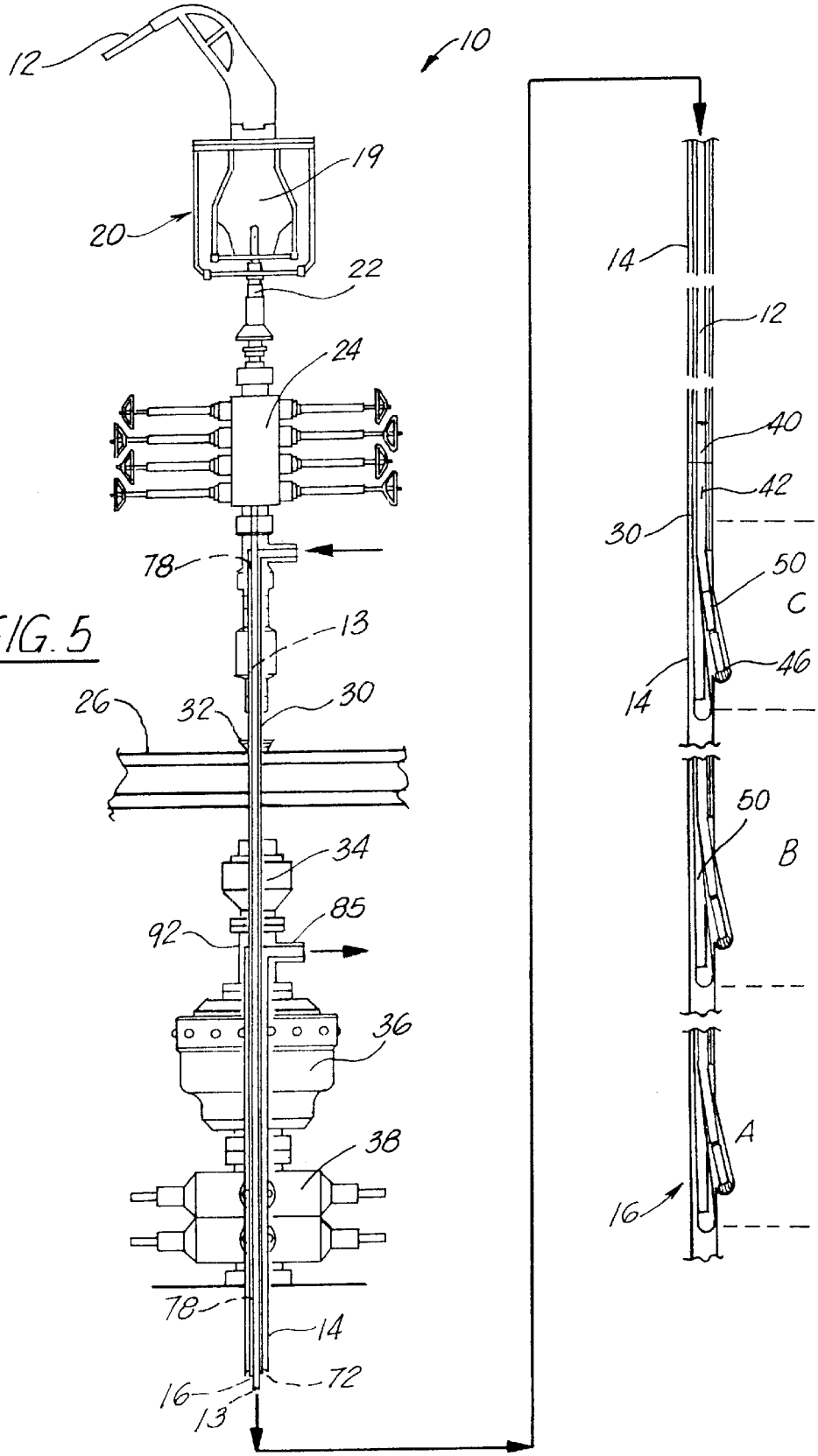
FIG. 5 illustrates a partial view of the underbalanced drilling technique showing the drilling of multiple radial wells from a single vertical or horizontal well while the well is maintained in the live status within the bore hole.

Therefore, FIG. 5 illustrates the utilization of the technique as seen in FIGS. 3A–3C, in drilling multiple radials off of the vertical or horizontal well. As illustrated for example, in FIG. 5, a first radial would be drilled at point A along the bore hole 16, utilizing the carrier string 30 as a downhole kill string 100 as described in FIG. C. Maintaining the radial well in the underbalanced mode, through the use of trip mode circulation 100, the drill bit 46 and coil tubing 12 is retrieved upward, and the upstock 50 is moved upward to a position B as illustrated in FIG. 5. At this point, a second radial well is drilled utilizing the same technique as described in FIG. 3, until the radial well is drilled and the circulation maintains underbalanced state and well control. The coil tubing 12 with the bit 46 is retrieved once more, to level C at which point a third radial well is drilled. It should be kept in mind that throughout the drilling and completion of the three wells at the three different levels A, B, C, the hydrostatic pressure within the carrier string 30 will be maintained by circulation down the carrier string to maintain wellbore control, and any drilling fluids and hydrocarbons which may flow upward within annulus 72 between the carrier string 30 and the outer casing 14. Therefore, utilizing this technique, each of the three wells are drilled and completed as live wells, and the multiple radials can be drilled while the carrier string 30 is alive as the drill bit 46 and carrier string 30 are retrieved upward to another level. FIGS. 4A & 4B illustrate the flow diagram in isolation for underbalanced drilling utilizing the two-string drilling technique in an upstock assembly with the fluid flowing down the annulus 78 between the drill pipe 12 and the carrier string 30, and being returned through the annulus 72 between the carrier string 30 and the outer casing 16.

FIG. 6 is simply an illustration in schematic form of the various nitrogen units 93, 95, and rig pumps 76, 79 including the air compressor 97 which are utilized in order to pump the combination of air, nitrogen and drilling fluid down the hole during the underbalanced technique and to likewise receive the return flow of air, nitrogen, water and oil into the separator 57 where it is separated into oil 99 and water 101 and any hydrocarbon gases are then burned off at flare stack 89. Therefore, in the preferred embodiment, this invention, by utilizing the underbalanced technique, numerous radial wells 60 can be drilled off of a borehole 16, while the well is still alive, and yet none of the fluid which is utilized in the underbalanced technique for maintaining the proper equilibrium within the borehole 16, moves into the formation and causes any damage to the formation in the process.

Figure 7A:
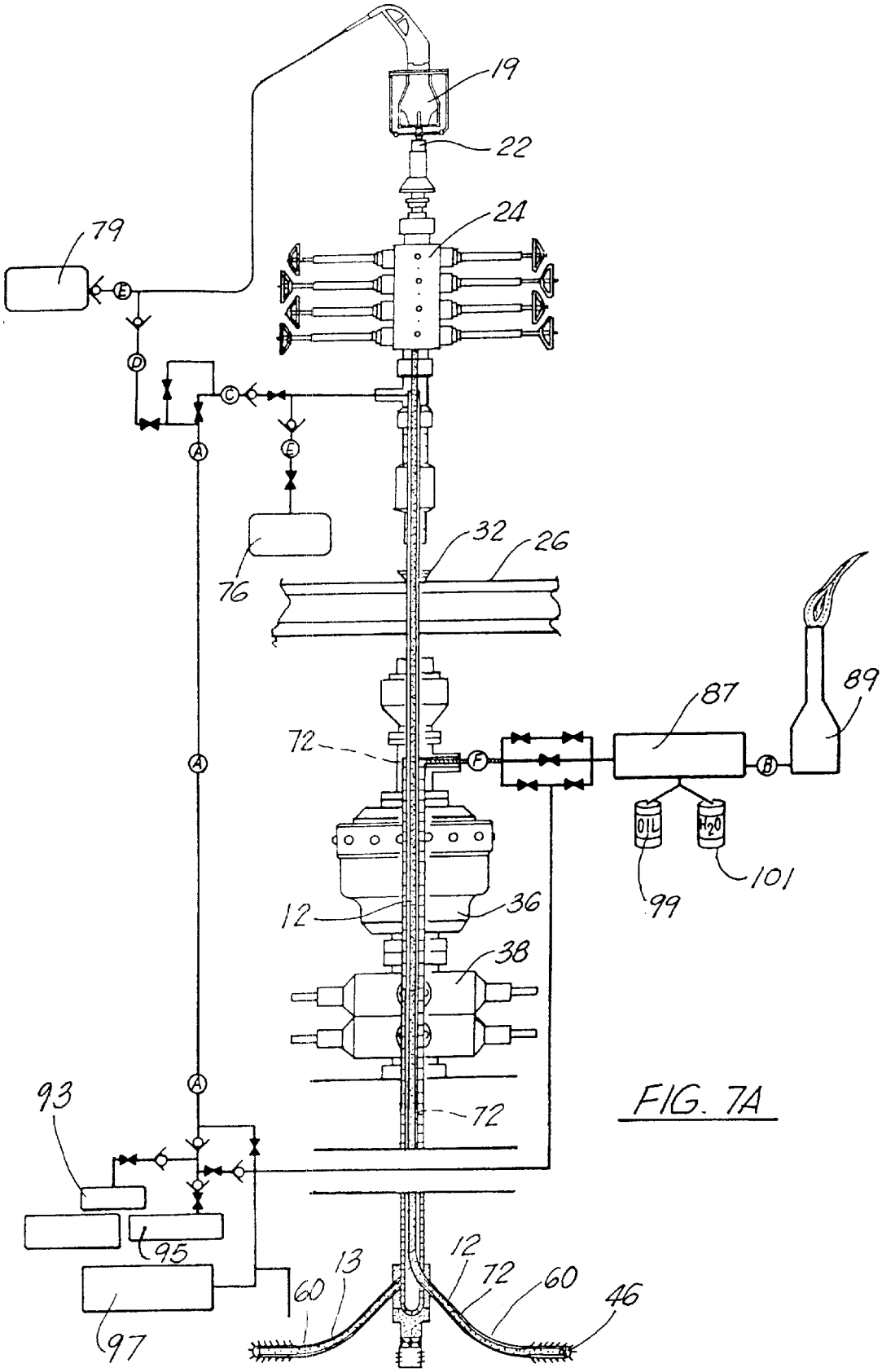
FIG. 7A illustrates an overall schematic view of an underbalanced radial drilling (with surface schematic) while producing from a wellbore being drilled, and a wellbore that has been drilled and is currently producing, with FIG. 7B illustrating a partial view of the system.
Figure 7B:
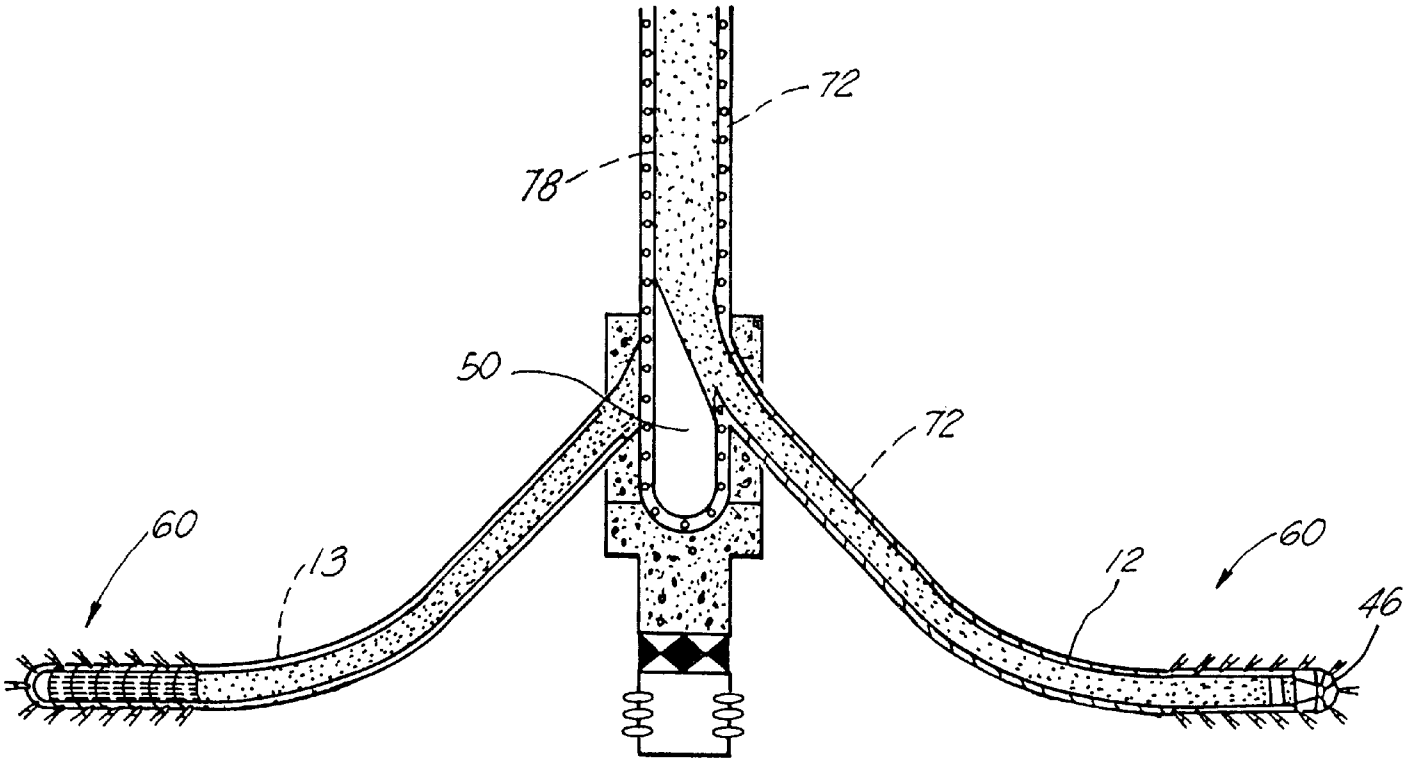

FIGS. 7A and 7B illustrate in overall and isolated views respectively, the well producing from a first radial borehole 60 while the radial borehole is being drilled, and is likewise simultaneously producing from a second radial borehole 60 after the radial borehole has been completed. As is illustrated, first radial borehole 60 being drilled, the coil tubing string 12 is currently in the borehole 60, and is drilling via drill bit 46. The hydrocarbons which are obtained during drilling return through the radial borehole via annulus 72 between the wall of the borehole, and the wall of the coiled tubing 12. Likewise, the second radial borehole 60 which is a fully producing borehole, in this borehole, the coil tubing 12 has been withdrawn from the radial borehole 60, and hydrocarbons are flowing through the inner bore of radial borehole 60 which would then join with the hydrocarbon stream moving up the borehole via first radial well 60, the two streams then combining to flow up the outer annulus 72 within the borehole to be collected in the separator. Of course, the return of the hydrocarbons up annulus 72 would include the air/nitrogen gas mixture, together with the drilling fluids, all of which were used downhole during the underbalanced drilling process discussed earlier. These fluids, which are co-mingled with the hydrocarbons flowing to the surface, would be separated out later in separator 87.

Figure 8A:
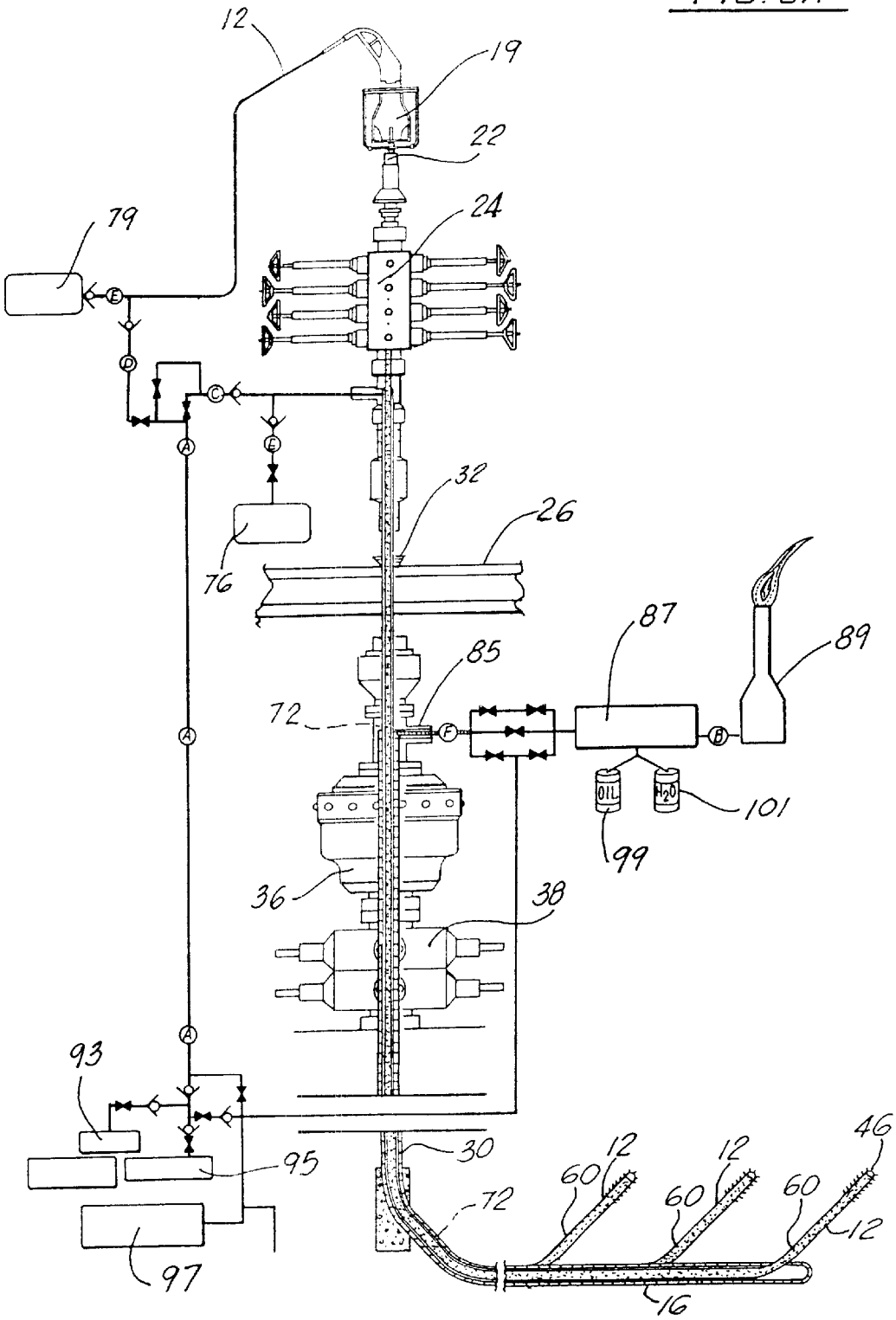
FIG. 8A illustrates an overall schematic view of underbalanced horizontal radial drilling (with surface schematic) while producing from a radial wellbore being drilled, and additional radial wellbores that have been drilled, with FIG. 8B illustrating a partial view of the system.
Figure 8B:
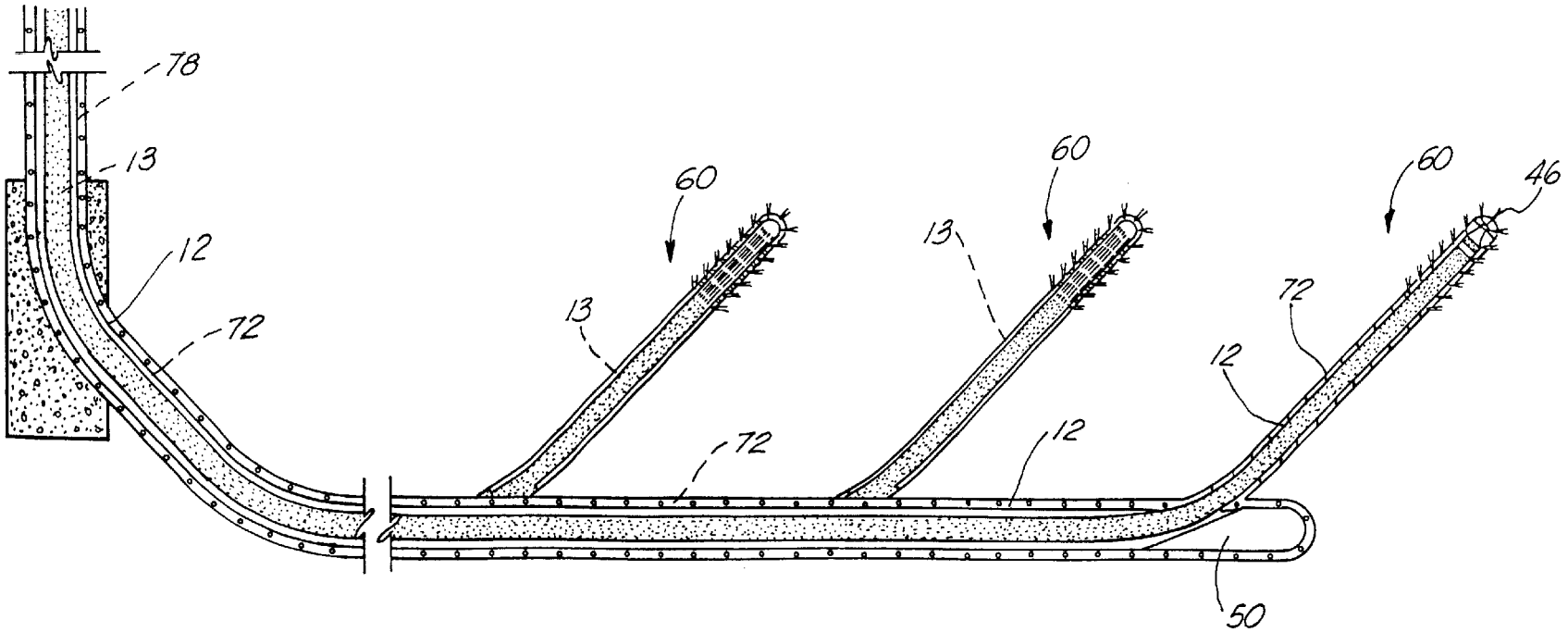

Likewise, FIGS. 8A and 8B illustrate the underbalanced horizontal radial drilling technique wherein a series of radial boreholes 60 have been drilled from a horizontal borehole 16. As seen in FIG. 7A, the furthest most borehole 60 is illustrated as being producing while being drilled with the coil tubing 12 and the drill bit 46. However, the remaining two radial boreholes 60 are completed boreholes, and are simply receiving hydrocarbons from the surrounding formation 70 into the inner bore of the radial boreholes 60. As was discussed in relation to FIGS. 7A and 7B, the hydrocarbons produced from the two completed boreholes 60 and the borehole 60 which was currently being drilled, would be retrieved into the annular space 72 between the wall of the borehole and the carrier string 30 within the borehole and would likewise be retrieved upward to be separated at the surface via separator 87. And, like the technique as illustrated in FIGS. 7A and 7B, the hydrocarbons moving up annulus 72 would include the air/nitrogen gas mixture and the drilling fluid which would be utilized during the drilling of radial well 60 via coil tubing 12, and again would be co-mingled with the hydrocarbons to be separated at the surface at separator 87. As was discussed earlier and as is illustrated, all other components of the system would be present as was discussed in relation to FIG. 6 earlier.

Figure 9:
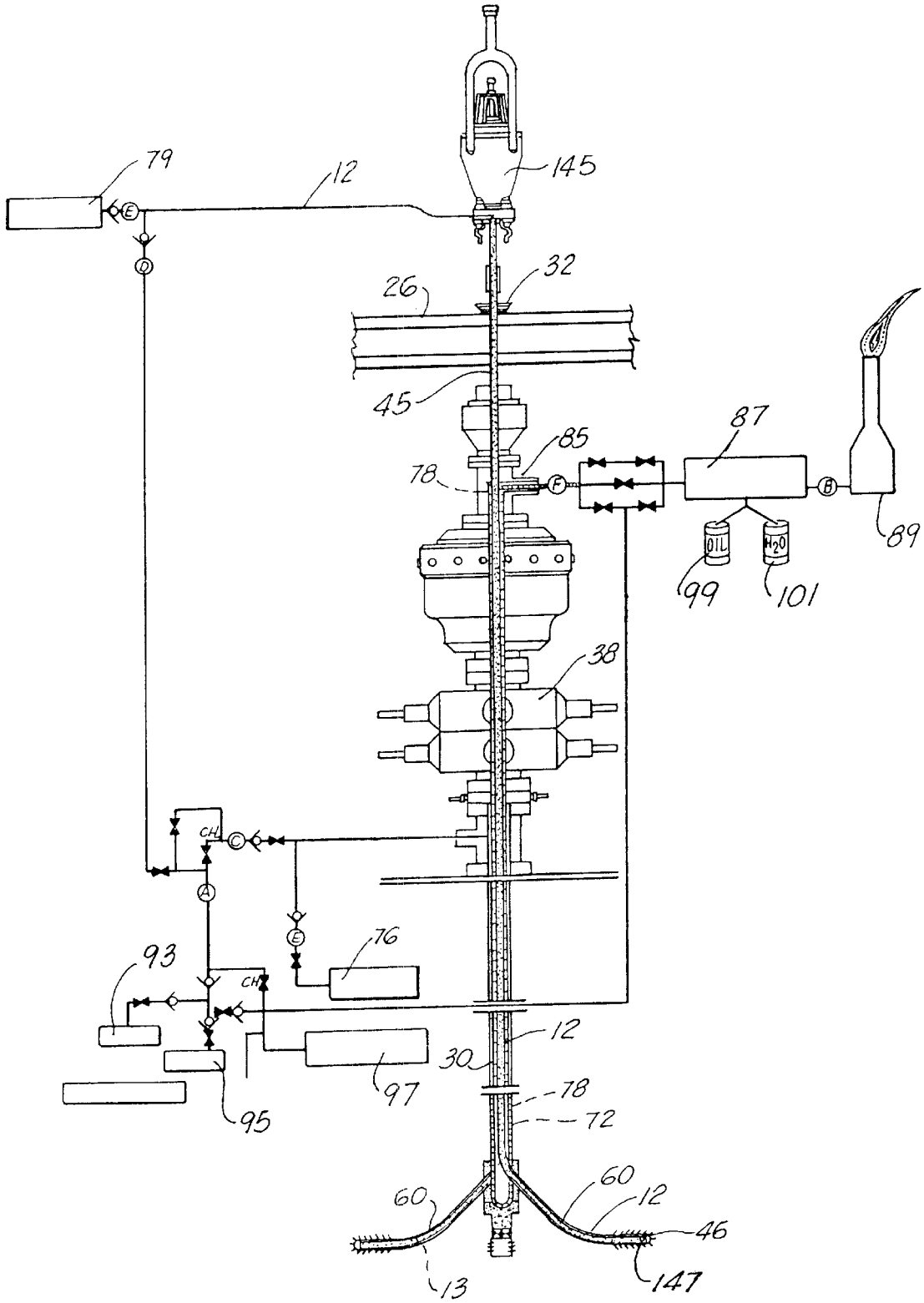
FIG. 9 illustrates a flow diagram for a jointed pipe system utilizing a top drive or power swivel system, for underbalanced drilling using the two string drilling technique with the upstock assembly where there is a completed radial well that is producing and a radial well that is producing while drilling.

Turning now to FIG. 9, the system illustrated in FIG. 9 again is quite similar to the systems illustrated in FIGS. 7A, 7B and 8A, 8B and again illustrate a radial borehole 60 which is producing while being drilled with drill pipe 45 and drill bit 46, driven by power swivel 145. The second radial well 60 is likewise producing. However, this well has been completed and the hydrocarbons are moving to the surface via the inner bore within the radial bore 60 to be joined with the hydrocarbons from the first radial well 60. Unlike the drilling techniques as illustrated in FIGS. 7 and 8, FIG. 9 would illustrate that the hydrocarbons would be collected through the annular space 78 which is that space between the wall of the drill pipe 45 and the wall of the carrier concentric string 30. That is, rather than be moved up the outermost annular space 72 as illustrated in FIGS. 7 and 8, in this particular embodiment, the hydrocarbons mixed with the air/nitrogen gas and the drilling fluids would be collected in the annular space 78, which is interior to the outermost annular space 72 but would likewise flow and be collected in the separator for separation.

Figure 10:
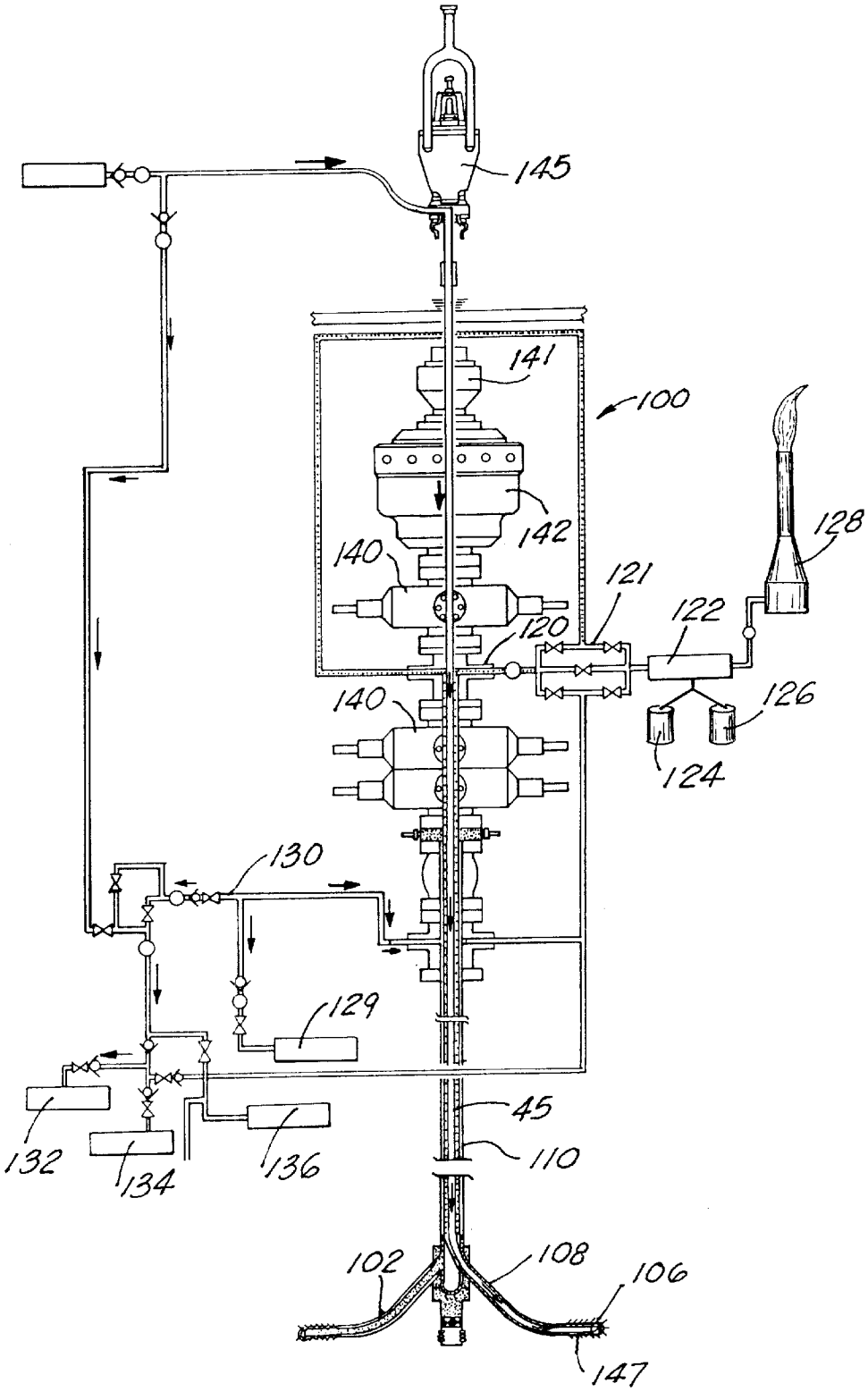
FIG. 10 illustrates a flow diagram for underbalanced drilling or completing of multilateral wells from a principal wellbore using the two string technique, including an upstock assembly, where there is illustrated a completed multilateral well that is producing and a multilateral well that is producing while drilling with a drill bit operated by a mud motor or rotary horizontal system is ongoing.
Figure 11:
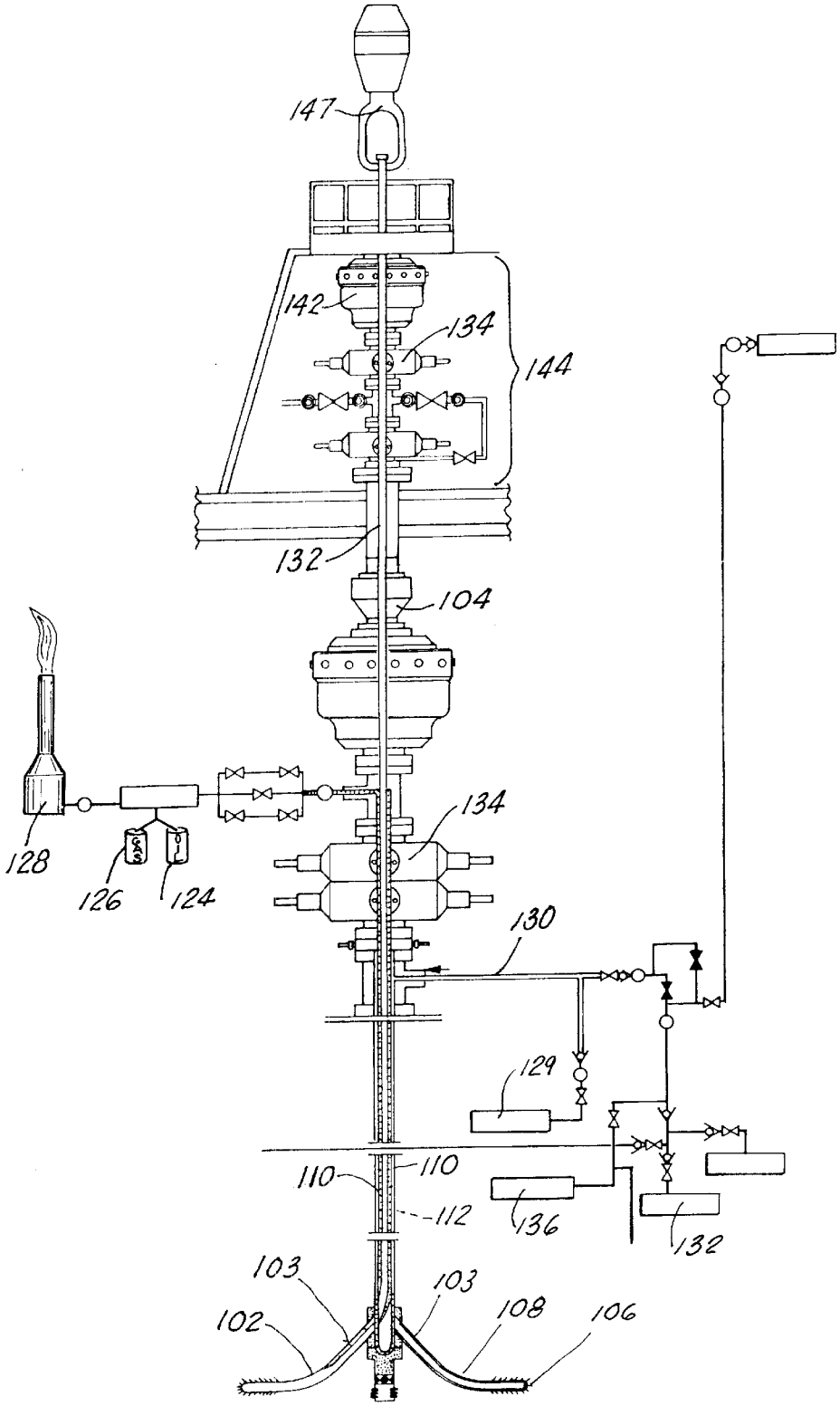
FIG. 11 illustrates a flow diagram for underbalanced drilling or completing of multilateral wells off of a principal wellbore utilizing the two string technique where there is a completed multilateral well that is producing and a multilateral well that is producing while drilling is ongoing utilizing drill pipe and a snubbing unit as part of the system.
Figure 12:
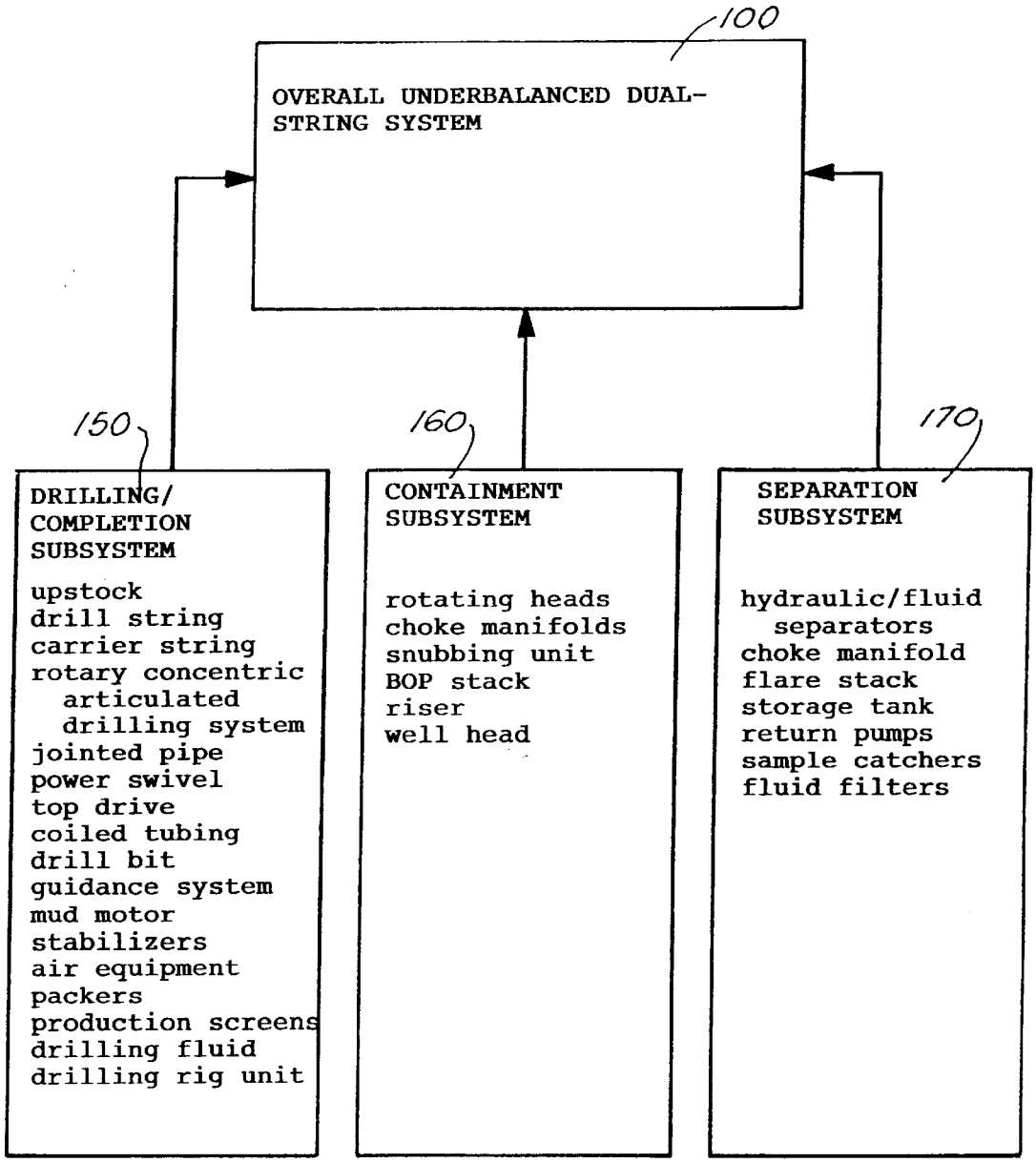
FIG. 12 is a representational flow chart of the components of the various subsystems that comprise the overall underbalanced dual string system of the present invention.

FIGS. 10 through 12 illustrate additional embodiments of the system of the present invention which is utilized for drilling or completing multilateral wells off of a principal wellbore. It should be noted that for purposes of definitions, the term "radial" wells and "multilateral" wells have been utilized in describing the system of the present invention. By definition, these terms are interchangeable in that they both in the context of this invention, constitute multiple wells being drilled off of a single principal wellbore, and therefore may be termed radial wells or multilateral wells. In any event, the definition would encompass more than one well extending out from a principal wellbore, whether the principal wellbore were vertically inclined, horizontally inclined, or at an angle, and whether the principal wellbore was a cased well or an uncased well. That is, in any of the circumstances, the system of the present invention could be utilized to drill or complete multilateral or radial wells off of a principal wellbore using the underbalanced technique, so that at least the principal wellbore could be maintained live while one or more of the radial or multilateral wells were being drilled or completed so as to maintain the well live and yet protect the surrounding formation because the system is an underbalanced system and therefore the hydrostatic pressure remains in balance.

FIG. 10, as illustrated, is a modification of FIG. 9, as was described earlier. Again, as seen in FIG. 10, the overall underbalanced system 100 would include first the drilling system which would in effect be a first multilateral borehole 102 which is illustrated as producing through its annulus up to surface via annulus 112, while a second borehole 108 is being drilled with a jointed pipe 45 powered by a top drive or power swivel 145, having a drill bit 106 at its end. The drill bit 106 may be driven by the top drive 145, or a mud motor 147 adjacent the bit 106, or both the top drive 145 and the mud motor 147. Fluid is being pumped down annulus 111 and hydrocarbon returns through the annulus between the drill string and the wall of the formation in the directional well. When the returns reach the upstock, the returns travel up annulus 112, commingling with the producing well 102. Simultaneously, fluids will be pumped down annulus 116, and this fluid joins the hydrocarbons up annulus 112.

As seen also in FIG. 9, FIGS. 10 and 10A illustrate that the hydrocarbons would be collected through the annular space 112 which would be defined by that space between the wall of the drill pipe 45 and the wall of the carrier string 114, which extends at least to the wellhead. Rather than the hydrocarbons moving up the outermost annular space 116 which would be that space between the outer casing 118 and the carrier string 114, in this embodiment, the hydrocarbons mix with the air nitrogen mix or with the other types of fluids would be collected in the annular space 112 which is interior to the most outer space 116 and would likewise flow and be collected in the separation system.

For clarity, reference is made to FIG. 10B which illustrates in cross sectional view the dual string system utilizing segmented drill pipe 45 rather than coiled tubing. The drill pipe 45 is positioned within the carrier string 114, and the carrier string 114 is being housed within casing 118. In this system, there would be defined an inner bore 111 in drill pipe 45, a second annulus 112 between the carrier string 114 and the drill pipe 45, and a third annulus 116 between the casing 118 and the carrier string 114. During the process of recovery utilizing segmented drill pipe 45, the drilling or completion fluids are pumped down annuli 111 and 116, and the returns, which may be a mixture of hydrocarbons and drilling fluids are returned up through annulus 112, which is modified from the use of coiled tubing as discussed previously in FIG. 2A.

Again, as was stated earlier, the overall system as seen in FIG. 10 would include the separation system which would include a collection pipe 120 which would direct the hydrocarbons into a separator 122 where the hydrocarbons would be separated into oil 124 and the water or drilling fluid 126. Any off gases would be burned in flare stack 128 as illustrated previously. Furthermore, the fluids that have been co-mingled with the hydrocarbons would be routed through line 120 where they would be routed through choke manifolds 121, and then to the separators 122.

This particular embodiment as illustrated in FIG. 10 also includes the containment system which is utilized in underbalanced drilling which includes the BOP stacks 140 and the hydril 142 and a rotating BOP 141 which would help to contain the system. This rotating BOP 141 allows one to operate with pressure by creating a closed system. In the case of coil tubing, the rotating BOP 141 and BOP stack controls the annulus between the carrier string and the outer casing, while in a rotary mode using drill pipe, when the carrier string is placed into the wellhead, there is seal between the carrier string and the outer casing, the rotating BOP 141 and the stack control the annulus between the drill pipe and the carrier string. Rotating BOPs are known in the art and have been described in articles, one of which entitled "Rotating Control Head Applications Increasing", which is being submitted herewith in the prior art statement.

Turning now to FIG. 11, again as with FIG. 10, there is illustrated the components of the system with the exception that in this particular configuration, the multilateral bore holes 102 and 108 with multilateral 102 producing hydrocarbons 103 as a completed well, and multilateral 108 producing hydrocarbons 103 while the drilling process is continuing. It should be noted that as seen in the FIGURE, that the hydrocarbons 103 are being co-mingled with the downhole fluids and returned up the carrier annulus 112 which is that space between the wall of the jointed drill pipe 45 and the wall of the carrier string 114. However when the drill pipe 45 is completely removed, returns travel up the annulus of the carrier string. As with the embodiment discussed in FIG. 10, the overall system comprises the sub systems of the containment system, the drilling system and the components utilized in that system, and the separation system which is utilized in the overall system.

However, unlike the embodiment discussed in FIG. 10, reference is made to FIGS. 11 and 11A where there appears the use of a snubbing unit 144 which is being used for well control during trips out of the hole and to keep the well under control during the process. With the snubbing unit 144 added, the well is maintained alive, and during the tripping out of the hole, one is able to circulate through the carrier string which keeps the well under control. As seen in the drawing, the snubbing unit 144 is secured to a riser 132 which has been nippled up to the rotating head at a point above the blow out assemblies 134. This is considered part of the well control system, or containment system, utilized during rotary drilling and completion operations. As is seen in the process, fluid is being circulated down annulus 116 between the carrier string and the wellbore and the returns are being taken up in annulus 112 between the drill string and the carrier string. The snubbing unit is a key component for being able to safely trip in and out of the wellbore during rotary drilling operations. When one is utilizing coiled tubing, there is a pressure containment system to control the annulus between the coiled tubing and the carrier string and the BOPs and rotating BOP 141 between the carrier string and the wellbore. With the use of the snubbing unit, this serves as the control for the annulus between the drill string and the carrier string. At the time one wishes to trip out of the wellbore, the snubbing unit 144 allows annular control in order to be able to do so since once it is opened, in order to retrieve the drill bit out of the hole, the well is alive. Therefore, the snubbing unit 144 allows one to retrieve the drill bit out of the hole and yet maintain the pressure of the underbalanced well to keep the well as a live well. It should be kept in mind that a snubbing unit is used only when the drilling or completion assembly is being tripped in and out of the hole.

Figure 11B:
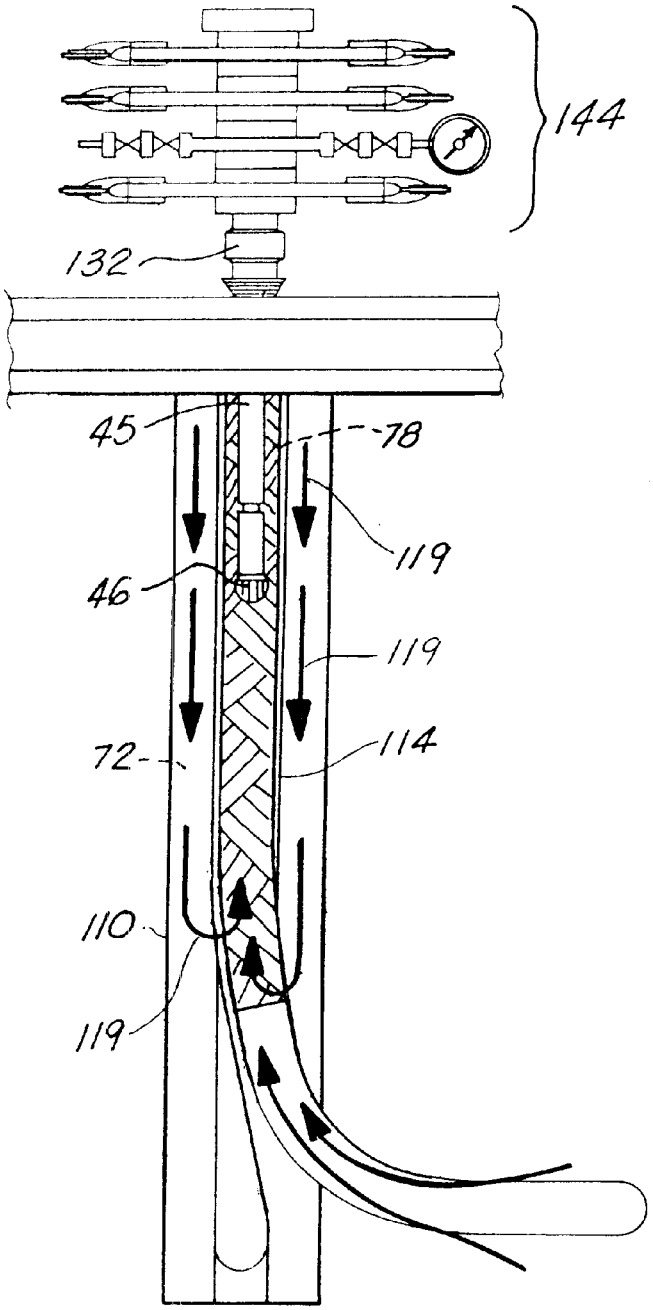
FIG. 11B illustrates the flow direction of drilling fluid and produced fluid for well control as it would be utilized with the snubbing unit during the tripping operation.

In the isolated view in FIG. 11B, there is illustrated the principal borehole 110, having the carrier string 114 placed within the borehole 110, with the drill string 45 being tripped out of the hole, i.e. the bore of the carrier string. As seen, the fluids indicated by arrows 119 are being pumped down the annular space 72 between the wall of the borehole 110 and the wall of the carrier string 114 and is being returned up the annulus 78 within the carrier string. The pumping of this trip fluid, i.e. fluid 119 down the annulus 72 of the borehole will enable the borehole to be maintained live, while tripping out of the hole with the drill string 45.

Figure 13:
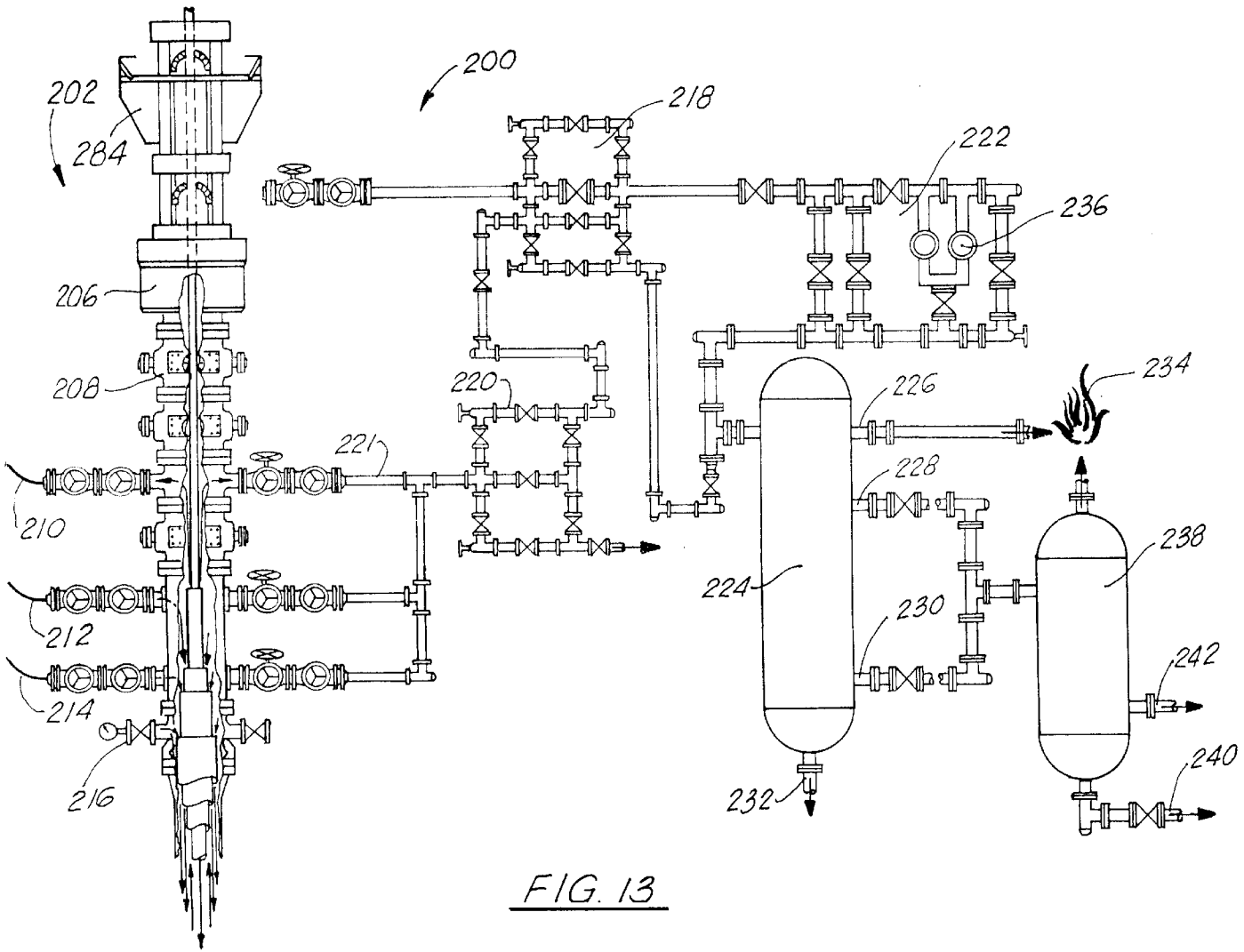
FIGS. 13 and 14 illustrate overall views of the embodiment of the present invention utilizing hydraulic friction controlled drilling for geopressured wells in concentric casing strings.
Figure 14:
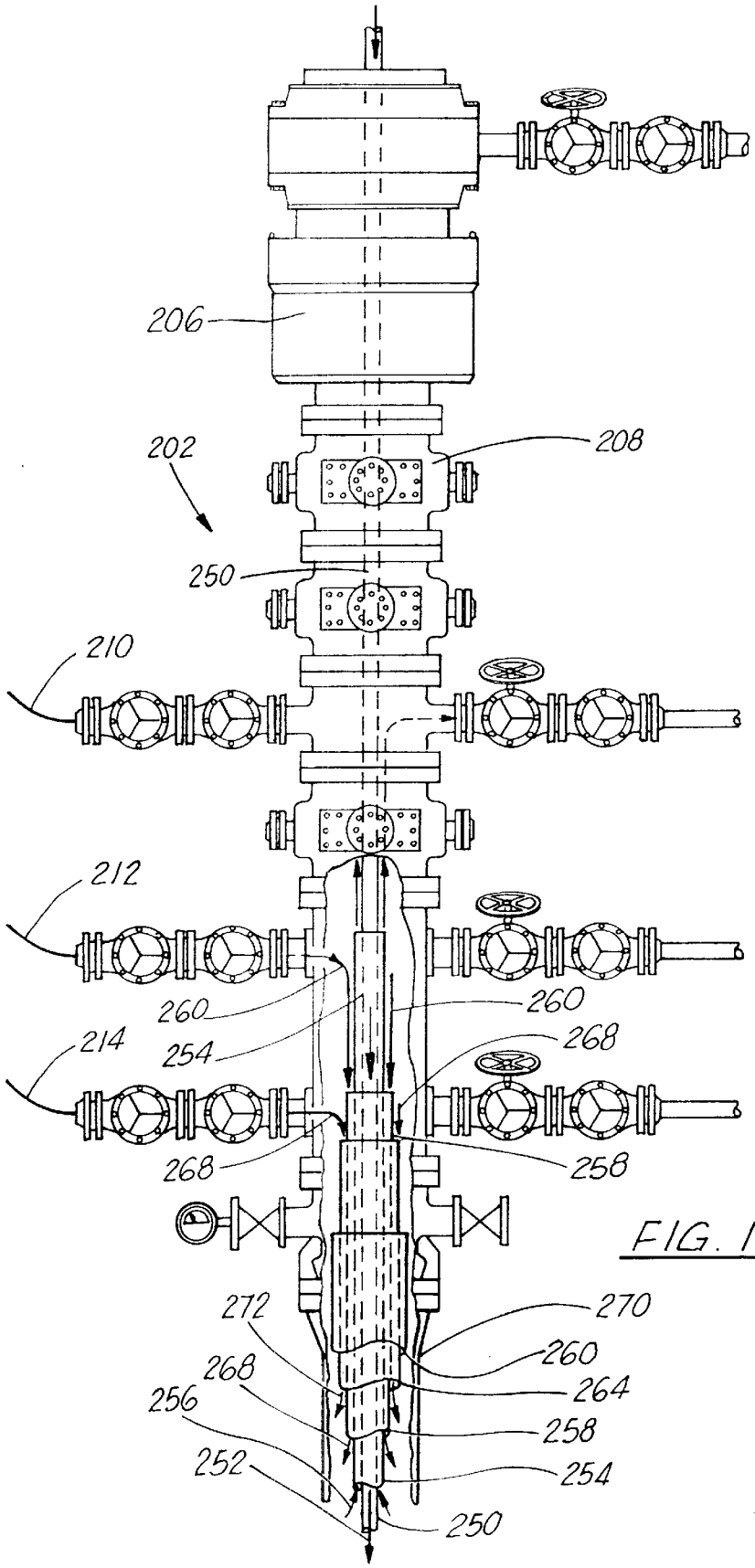

As was discussed previously in FIGS. 1–11, FIG. 12 illustrates a rough representation of the various components that may be included in the subsystems which comprise the overall, underbalanced dual string system 100. As illustrated, there is a first drilling/completion subsystem 150 which includes a list of components which may or may not be included in that subsystem, depending on the type of drilling or completion that is being undertaken. Further, there is a second subsystem 160 which is entitled the containment subsystem, which is a subsystem which comprises the various components for maintaining the well as a live well in the underbalanced the equilibrium that must be maintained if it is to be a successful system. Further. there is a third separation, subsystem 170 which comprises various components to undertake the critical steps of removing the hydrocarbons that have been collected from downhole from the various fluids that may have been pumped downhole in order to collect the hydrocarbons out of the formation. It is critical that all of the subsystems be part of the overall dual string system so that the method and system of the present invention is carried out in its proper manner. FIGS. 13 and 14 illustrate the overall view of the embodiment of the present invention utilizing the hydraulic friction techniques to control drilling for geopressured wells.

In FIG. 13, there is illustrated the overall view of the system of the present invention utilizing hydraulic friction techniques by the numeral 200. As illustrated in FIG. 13, system 200 includes the principal downhole unit 202 which includes a snub drilling unit 204, an annular preventer 206, blind/shear rams 208 and a plurality of fluid injection lines 210, 212, and 214. The injection lines will be the lines which would inject the multiple lines of fluid downhole under the process as was described earlier and will be described further in the test portion of this specification. There is further included a pressure gauge 216 which is normally read out on the drill floor (not illustrated). Further, the other general components which are included in the hydraulic friction drilling system is the choke manifold 218, the hydraulic choke manifold 220, a control sampling manifold 222, a four phase separator 224, including a gas outline 226, an auto outlet 228 and a water outlet 230. The solid slurry would be removed from the lower removal bore 232. The gas outlet would lead to a flare stack 234 and control and sampling manifold 222 would include a pair of dual sampling catchers 236. The oil outlet 228 and water outlet 230 would flow into a mud gas separator 238 wherein there would be included a duct line 240 to a pit and a mud return for the shell shape or the like 242.

The system that was described briefly is quite a standard system in an underbalanced drilling system. The present invention would be focused primarily on the principal downhole unit 202 and the plurality of casings which would be utilized in the concentric casing system utilizing the hydraulic friction techniques. These various casings can be seen more clearly in FIG. 14 where the downhole unit 202 is shown in isolated view. First there is illustrated the internal drill pipe itself 250 which may be drill pipe or tubing which includes an annulus 252, illustrated by arrow 252, to show that fluid is flowing within the annulus within the drill pipe 250 in the direction of downhole. Next, there is seen a first concentric casing 254 which would be positioned around the internal drill pipe 250 and would be preferably a 5½" casing, defining an annulus 256, between the drill pipe 250 and the casing 254, wherein fluid flow would be traveling up the annulus, shown by arrows 256. Next, there would be a second concentric casing 258, which again would be positioned around the casing 254 and define an annulus 260 therebetween. Casing 258 would preferably be a 7¾" casing wherein as with the drill pipe, fluid would flow in the direction of downhole, as seen by the arrows 260. The fluid flow in the casing 258 would be flow that is received from injection line 212 as seen by arrow 260, as stated earlier in regard to FIG. 13. There would yet be a third casing 264, which would be positioned concentric to casing 258 and would preferably be a 9⅝" casing. Casing 264 would define an annulus 268 between itself and casing 258 and which annulus would receive fluid from injection line 214 which would travel downhole in the direction of arrow 268. Finally, there would be yet a fourth casing 270, preferably 13⅜" casing, which would be positioned below injection line 214 and would define an annulus 272 between itself and casing 264. No fluid would travel downhole, within the cemented 272. Casing 270 would be housed within the outermost casing 276, having no fluid flow therebetween, casing 276 being preferably a 20" casing, and which would define the outer wall of the principal down system 202.

What is clearly seen in FIG. 14, is the fact that there is defined a total of four flow spaces through which fluid flows in the system, annuli 252, 256, 260, and 268. Again, as seen in FIG. 14, there is downhole fluid flow within the annulus 252 of the drill pipe 250, there is uphole flow within the annulus 256 defined between drill pipe 250 and casing 254, there is downhole flow in the annulus 260 defined between the casing 254 and 258, and there is downhole flow in the annulus 268 defined by casing 258 and 264. Therefore, it is clear that the fluid flow downhole within the various annuli is significantly greater, a ratio of 3 to 1, than the up flow fluid within the annulus defined between the drill pipe 250 and the casing 254. This being the case, as the fluid flows upward in the direction of the arrow 256 into the manifold 220, through line 221, there is a controlling factor between the two regulated flows caused by a frictional component as the fluid flowing downhole within three separate annuli is forced up the single annulus between casing 250 and 254. It is this additional frictional component within the annulus that would control the well, the added friction dominated control in addition to the hydrostatic weight of the fluid will control the bottom hole pressure utilized in the drilling process. This system can only be accomplished through the use of a plurality of concentric strings or casings in the manner similar to the configuration as shown in FIG. 14, which lends itself to defining the frictional component which is in effect, the basis by which the well is controlled in this invention.

What follows is the result of a test which was conducted utilizing the very techniques that were discussed in this specification in regard to FIGS. 13 and 14 of the present invention, and the use of the hydraulic friction technique to control the drilling in geopressured wells. It is clear from this experimental test that the system is workable and defines a new method for controlling wells other than simply the hydrostatic weight of the fluid utilized in the wells which is currently done and which does not solve the problems in the art.

Experimental Test Utilizing the Invention

The first implementation of this friction control technique took place in an actual drilling application. An operator began drilling operations into an abnormally pressured gas reservoir in the Cotton Valley Reef trend in Texas. Due to the harsh environment of this reservoir, including bottom hole temperatures in excess of 400° F. sour gas content with both $H_2S$ and $CO_2$ present and well depths below 15,000 feet and a very narrow band between ECD and fracture gradient, this well was considered to be extremely critical.

In addition, the operator was faced with a potentially prolific gas delivery volume from the reservoir. To contact maximum reservoir exposure, the operator compared the potential benefits of hydraulic fracturing against drilling a horizontal lateral. Previous fracture stimulated wells in this type of reservoir were largely uneconomic. Therefore, the operator elected to drill the well horizontally through the section.

To avoid the drilling damage from barite solids fallout and plugging in a water-based fluid or varnishing effects of an oil-based fluid at this high bottom hole temperature, the operator elected to use a solids free clear brine weighted fluid. This type of fluid also lent itself to possible use in underbalanced drilling as a further means of minimizing formation impairment resulting from filtrate fluid invasion or solids plugging.

To summarize the challenges faced with this well, the risks were:

Reservoir temperature>400° F.

Extreme depth of well>15000'

Potentially prolific gas production

Sour gas content of reservoir fluids ($H_2S$ and $CO_2$)

Special drilling fluids (weighted, solids-free brine)

Directional single lateral>3,000'

Underbalanced drilling option to minimize reservoir drilling damage. In light of the above special needs, the operator elected to utilize the additional well control advantages of the friction control system to supplement the normal conventional well control options. Well Design Requirements:

In addition to the normal casing design requirements for depth, pressure, temperature and type of service for a conventional well, hydraulic frictional controlled drilling calls for one additional level of design before selecting the final casing sizes, weights and grades. Also, the proper selection of a compatible sized drill pipe is essential. What is called for is an ability to inject sufficient fluid volume down one (or more) concentric casing strings and take total returns up a return annulus that is sufficiently restricted by the drill pipe to create adequate friction. In simple terms, the optimum design for friction controlled drilling requires a large injection annulus and a small return annulus. The hydraulic friction should be minimized on the injection side to require less hydraulic horsepower and be maximized on the return side to create the desired subsurface friction to control the well. The larger injection annulus also minimizes casing design requirements by allowing injection operations to take place at a lower surface pressure. The return annulus carries back to surface both the standpipe injection volume as well as the annulus injection volume(s) along with drill cuttings. For underbalanced wells, any produced reservoir fluids would also be carried to the surface via this same return annulus.

This design phase of the well is critical for hydraulic frictional well success. Typically in the type of deep, high-pressure application normally associated with this type of well, premium casings are called for. Special high collapse, high performance casings from Tubular Corporation of America (TCA), a division of Grant Prideco fills this specialty, premium pipe niche. TCA stocks a full line of large diameter, heavy wall, and high alloy "green tubes" that are suitable for quick delivery in sour gas applications. Green tubes are casings that have already completed the hot mill rolling, initial chemical testing and dimensional inspection processes. As a result, final products selected from the green tube inventory require only final heat treating to create strengths ranging from N-80 up to TCA-150 grades, and can make delivery schedules in days or weeks rather than months.

Likewise, high-temperature, high-pressure 10M or 15M wellheads, generally made from special metallurgy forgings, are called for. For the above initial test well, Wood Group Pressure Control supplied a 15M complete stainless wellhead. A unique design allowed the high strength tieback casing string to be temporarily hung off in the head with exposed injection ports open just above the polished bore receptacle (PBR) at the top of the liner. Two sets of high-temperature seals were located just above the perforated sub. A longer than normal PBR located above the liner top permitted partial insertion of the tieback casing stinger into the PBR without "burying" the perforated sub and shutting off annular injection. Allowance was made for temperature expansion or contraction so that the perforated sub could remain partially inside the PBR and yet is exposed for injection. Once the well was finished drilling, this special casing head section allowed for the tieback casing to be picked up to add a pup joint casing section and re-position the casing deeper into the PBR to engage the upper seal assemblies. At this point, the pipe could be tack cemented on the bottom or left uncemented at the operator's election. The seal assemblies on the stinger of the tieback string would isolate the lower perforated sub for full pressure integrity of the tieback casing.

Thought was also given to possible multiple injection annuli for more complex wells. A wellhead was designed and built to allow two injection options for another possible well. In that case, two tieback casing strings (7¾" and 5½") above drilling liners (7⅝" and 5½") were designed to be hung off in a special casing head section. This head made provision for annular injection down either (or both the 9⅞"×7¾"×5½" annuli. Both tieback strings were capable of being picked up and lowered into each casing's PBR upon conclusion of the drilling/injection operation.

Finally, in the case of typical high pressure/high temperature wells, provision for chemical treating is a requirement when dealing with sour gas conditions. Wood Group Pressure Control also designed and built a special purpose "Gattling Gun" head that allowed chemical injection down a 2⅜" treating (or kill string) with production flow up the larger outside annulus. Wood Group also manufactured the final 15M upper Christmas tree used on the first friction controlled drilling test well. Casing Design Casing program for a typical deep onshore test well might include 20" conductor casing 13⅜" surface casing, 9⅝" intermediate casing, 7⅝" drilling liner (#1) and 5½" drilling liner (#2). In this particular initial well, the 7⅝" first drilling liner was tied back to the surface with 7¾" premium casing because the pressure rating on the 9⅝" intermediate casing was insufficient to handle expected collapse and burst pressure requirements. Upon drilling out below the 7⅝" liner to the top of the reservoir objective below 15,000 feet, another 5½" drilling liner was run and cemented on the test well.

To determine optimum geologic and reservoir data a vertical pilot well was drilled to the base of the zone. This interval was cored and open hole logged for reservoir data. Instead of abandoning this productive pilot hole section with a cement plug to kick-off and build the curve section, a decision was made to retain the pilot hole for future production. A large bore "hollow" whipstock was set that allowed flow up a 1" bore from the lower pilot hole and provided the kick-off for the curve and lateral.

Before drilling the curve and lateral section into the productive section of the reservoir, the 5½" liner was also tied back to surface using 29.70# T-95 FJ casing. Rather than totally isolating this tieback string, provision was made to enable fluid injection between the 7¾" c 5½" casings. Returns were taken up the 5½×2⅞" drill pipe annulus. After the 5½" tieback casing was run, 2⅞" 7.90# L-80 PH-6 tubing was used as drill pipe in this sour, horizontal environment.

If the 5½" liner and tieback casing had not been required, larger drill pipe than 2⅞" could have been utilized. In that case, annulus fluid injection could have been designed between the 9⅝×7¾" casings. Returns in that case could be taken up the 7¾×4½" drill pipe annulus.

Although not done in the initial well, both annuli (9⅝× "7¾" and 7¾"×5½") could have been used for fluid injection from the surface. Surface Equipment Requirements Keeping in mind that the final well design is engineered to create a higher level of well control than conventional drilling, special surface equipment is also required to safely complete this mission. The list of such equipment includes a rotating wellhead diverter like toe 5000-psi Weatherford (Williams) Model 7100 dual element control head or the 3000-psi Weatherford (Alpine) Model RPM-3000 dual element rotating BOP. Either head can be installed on 13¹⁵⁄₈, 11" or 7¹⁄₁₆ 5M bottom mounting flanges depending upon the stack application. The Model 7100 is a passive dual stripper rubber element tool that operates using wellbore pressure to push the upper and lower rubbers against the pipe. The Model RPM-3000 contains one active lower rubber element that is hydraulically energized to seal against the pipe and one passive upper rubber element that seals using wellbore pressure.

One of the above described wellhead diverters, the Model 7100 rotating control head or the Model RPM-3000 rotating blowout preventer, should be mounted on top of the blowout preventer stack. In the case of the test well, the normal BOP stack consisted of 11" 15M pipe rams (2 sets), 11" 15M blind/shear rams and 11" 5M annular preventer. It is very important to emphasize the importance of maintaining a complete BOP stack, complete with its choke and kill lines and high-pressure choke manifold, for well control purposes. The rotating wellhead diverter is intended to supplement this standard equipment to add a higher level of well control options.

A high pressure 4" or 6" flowline connects the rotating diverter to a special choke manifold. For underbalanced drilling applications, this is typically referred to as the UBD manifold. This manifold serves as the primary flow choke with the well control choke line and higher pressured choke manifold serving as the secondary back-up system. In the case of the first test well above, the primary flow manifold had a 5M rating, and the secondary choke manifold had a 15M rating. Both chokes had dual hydraulic chokes for redundancy and a central "gut line." Each gut line was piped with individual blooie lines to a burn pit for emergencies. The 15M manifold was connected to the 5M manifold off one wing as its primary flow path and to a low-pressure 2-phase vertical mud/gas separator off the other wing as its secondary flow path. The 5M manifold was connected off one wing as its primary flow path to a 225-psi working pressure 4-phase horizontal separator and to the same low-pressure 2-phase vertical mud/gas separator off the other wing as its secondary flow path.

To provide redundancy in the gas flares, two separate vertical "candlestick" flares were provided on the initial well job. A 12" flare line carried gas off of the low-pressure 2-phase vertical mud/gas separator. A 6" flare line carried gas off of the 225-psi working pressure 4-phase horizontal separator and to the same low-pressure 2-phase vertical mud/gas separator off the other wing as its secondary flow path.

An emergency shut down (ESD) system can be incorporated into the flow system to deal with unexpected emergencies. A critical point to consider for ESD systems is that if they are designed to be a total shut-in safety device, some planning is required to avoid a serious problem. For example, if the pumps are circulating drilling fluid and a surface high-pressure flowline o choke washes out due to erosion and the ESD is tripped shut, the fluid in the system will continue to move and a failure elsewhere will occur. Most likely, fluid will be forced out the top of the rotating wellhead diverter as it has no where else to go. This of course is the worst possible place for well fluids (possibly containing hydrocarbons) to go, because they will erupt onto the rig floor where personnel are working and hot engines are running.

A preferred solution would be for the ESD to trigger a "soft" shut-in whereby the pumps are also simultaneously shut down to avoid the "hard" shut-in, or perhaps where multiple HCR valves are interconnected, to simultaneously shut-in the primary flowline to the 5M choke and open the 15M choke line. This fail open route is safer than the hard shut-in and avoids forcing fluids out the top of the diverter due to fluid piston effects.

The foregoing embodiments are presented by way of example only; the scope of the present invention is to be limited only by the following claims.

What is claimed is:

1. A method of controlling fluid flow during the drilling of wells under pressure, comprising the following steps:

a) providing a principal drill string in a principal wellbore;

b) providing at least first and second concentric casing strings surrounding at least a portion of the principal drill string in the principal wellbore;

c) pumping a controlled volume of fluid down the drill string and the at least first concentric casing string and returning the fluid up a common return annulus in the second concentric casing string, so that the friction caused by additional fluid flow up the return annulus is greater than the friction caused by the fluid flow returning from just the principal drill string to frictionally control the well.

2. The method in claim 1, wherein the fluid flowing down the plurality of concentric casing strings and returning up the common return annulus defines a frictional component within the system which restricts the return fluid flow to control the well.

3. A method of drilling oil and gas wells under pressure, utilizing hydraulic frictional controlled drilling, comprising the steps of:

a. providing at least two concentric casing strings to define an plurality of (annulus) annuli;

b. injecting fluid down some of the annuli;

c. returning the fluid up at least one return annulus so that the return flow creates adequate hydraulic friction within the return annulus to control the return flow within the well.

4. The method in claim 3, wherein the oil and gas well comprises a straight, or directional or horizontal or multilateral well.

5. A system for controlling fluid flow within an oil and gas well under pressure, which comprises:

a. a first drilling string defining a first annulus therein;

b. a plurality of casings positioned around the drill string to define a plurality of annuli therebetween;

c. fluid flowing down some of the plurality of annuli and returning up at least one common return annulus, for defining a frictional component within the system to restrict the return fluid flow sufficiently to control the well.

6. The system in claim 5, wherein the oil and gas well comprises a straight, or directional or horizontal or multilateral well.

* * * * *

UNITED STATES PATENT AND TRADEMARK OFFICE

CERTIFICATE OF CORRECTION

PATENT NO. : 6,457,540 B2 
DATED : October 1, 2002
INVENTOR(S) : Robert Gardes

It is certified that error appears in the above-identified patent and that said Letters Patent is hereby corrected as shown below:

Column 4,
Line 54, replace “hydril” with -- annular blowout preventor --

Column 6,
Line 4, replace “36” with -- 26 --

Column 10,
Line 33, replace “hydril” with -- annular blowout preventor --

Signed and Sealed this

Eleventh Day of February, 2003

JAMES E. ROGAN
*Director of the United States Patent and Trademark Office*